US005966908A

United States Patent [19]

Philipp et al.

[11] Patent Number: 5,966,908

[45] Date of Patent: Oct. 19, 1999

[54] ARTICLE PACKAGING MACHINE AND METHOD OF PREVENTING THE FORMATION OF DEFECTIVE PACKAGES

[75] Inventors: Timothy Philipp, Sarasota, Fla.; Daniel W. Pruett, Colbert, Ga.; David J. Fosshage, Madison, Wis.

[73] Assignee: Food Machinery Sales, Inc., Athens, Ga.

[21] Appl. No.: 09/027,154

[22] Filed: Feb. 20, 1998

[51] Int. Cl.[6] ..... B65B 9/06; B65B 57/12

[52] U.S. Cl. ..... 53/450; 53/51; 53/493; 53/75; 53/550

[58] Field of Search ..... 53/450, 493, 499, 53/550, 51, 55, 75

[56] References Cited

U.S. PATENT DOCUMENTS

| | | | |
|---|---|---|---|
| 4,506,488 | 3/1985 | Matt et al. . | |
| 4,525,977 | 7/1985 | Matt . | |
| 4,722,168 | 2/1988 | Heaney . | |
| 4,924,657 | 5/1990 | Berti et al. . | |
| 4,955,176 | 9/1990 | Seko et al. . | |
| 4,964,258 | 10/1990 | Seko et al. . | |
| 5,351,464 | 10/1994 | Francioni . | |
| 5,524,420 | 6/1996 | Ikuta | 53/450 |
| 5,566,256 | 10/1996 | Suga . | |
| 5,678,390 | 10/1997 | Pruett et al. . | |
| 5,689,942 | 11/1997 | Suga | 53/550 |

*Primary Examiner*—John Sipos

*Attorney, Agent, or Firm*—Charles H. Fails

[57] ABSTRACT

An improved article packaging machine, and method of using same to prevent the formation of empty or defective packages is disclosed. The rotational position of the drive axis (45) of a film feed drive (44), and the drive axis (53) of a cutting head drive (52) are mapped with respect to one another in a base rotational position relationship, whereupon both of these drive axes are mapped to the rotational position of the drive axis (41) of an infeed conveyor drive (40) in a slave/master relationship, respectively. A machine controller (34) then calculates at least a first position control trajectory profile, and establishes a first rotational position relationship of the drive axes with respect to one another. The packaging machine includes a detector (56) for detecting whether articles are present within the flights (15) of the infeed conveyor (13), and if an empty pocket is detected, the machine controller then calculates a second position control trajectory profile and a second rotational position relationship which replaces the first position control trajectory profile and rotational position relationship, respectively, within the controller, and adjusts the rotational position of the film feed drive axis and the cutting head drive axis with respect to the rotational position of the infeed conveyor drive axis to ensure that an empty package is not formed. The machine controller is also adapted to set the infeed conveyor and film feed drives into a base/master rotational position relationship, and to map the rotational position of the cutting head drive to the infeed conveyor and film feed drives to operate the respective drives for preventing the formation of empty packages.

53 Claims, 8 Drawing Sheets

ARTICLE PACKAGING MACHINE AND METHOD OF PREVENTING THE FORMATION OF DEFECTIVE PACKAGES

FIELD OF THE INVENTION

This invention relates in general to packaging machinery. More particularly, this invention relates to an improved end seal horizontal wrapping machine, and a method of using same, which prevents the formation of defective packages during the packaging of articles therewith.

BACKGROUND OF THE INVENTION

Horizontal wrapping machines have proven to be useful for packaging a wide variety of articles, to include, but not limited to, foodstuffs, computer diskettes, greeting cards, advertising material, and the like. A typical horizontal wrapping machine will have an elongate infeed conveyor extending along a path of travel through the packaging machine, the infeed conveyor having a series of spaced infeed flights, or pockets defined along its length and moving in the direction of the path of travel. Provided as either a part of the packaging machine, or as an accessory to the machine, is an article magazine or article placement device adapted to place individual articles, or a plurality of articles, for example in a stacked relationship, within the flights of the infeed conveyor. Thereafter, the articles are moved toward a downstream packaging film forming shoe, in which the articles will be entrained within a tube of packaging film formed about the articles, and in which the articles will be moved downstream of the film forming shoe along the path of travel.

Once entrained in the tube of packaging film, the articles and film tube are drawn through a fin wheel assembly, also known as a fin seal assembly, having opposed pairs of fin wheels which engage the bottom/side edges of the tube of packaging film and form a fin seal, or bottom seal, along the length of the now completed tube of film, and which is otherwise open at its ends about each article, or group of articles passed into the film from the infeed conveyor. Thereafter, the entrained articles and the tube of packaging film are passed to a downstream sealing and crimping head assembly, in which a pair of opposed and counter-rotating sealing and crimping, or cutting, heads are positioned. The tube of packaging film is passed between the opposed cutting heads whereupon, in known fashion, the packaging film is cut at the spaced ends of each article package for forming separate article packages out of the continuous tube of articles, the cutting heads being heated for crimping or heat sealing the packaging film together at the spaced ends of the article(s) to form a completed article package. Examples of such horizontal wrapping machines are disclosed in U.S. Pat. No. 5,678,390 to Pruett, el al.; U.S. Pat. No. 5,351,464 to Francioni; U.S. Pat. No. 4,525,977 to Matt; and U.S. Pat. No. 4,506,488 to Matt, et al.

One feature of horizontal wrapping machines is the production rates, and thus production efficiency, which can be realized by using these machines. However, as horizontal wrapping machines tend to be used with relatively small articles, for example individual or stacked cookies and crackers, problems can arise with ensuring that an article to be packaged is present within each flight of the infeed conveyor. Where an article is not present within a flight, the infeed conveyor will continue to advance regardless of this fact, packaging film will continue to be drawn over the film forming shoe, and the end result is that empty packages will be formed which must later be removed from the finished article package stream moving downstream away from the machine, and prior to packaging and/or shipment of the packaged articles. Not only does this reduce productivity by requiring manpower to find and remove the incomplete packages, but this also leads to increased packaging costs by wasting packaging film. Moreover, the possibility arises that if articles are not present within the tube of packaging film as it is passed between the cutting heads, the packaging film could possibly foul the cutting heads thus necessitating machine shut down to clean the cutting heads.

In the effort to address this problem, Seko, et al. in U.S. Pat. No. 4,964,258, disclose a Packaging Article Inclusion-Proofing Device For End-Sealing Mechanism constructed and arranged to detect when an empty flight, or flights, exist within the infeed conveyor, whereupon the cutting heads are decelerated to a full stop, and the fin wheels of the fin seal assembly will simultaneously opened thus releasing the packaging film from therebetween to ensure that no packaging film is drawn through the machine unless an article is going to be present within the film. Once an article is detected in the oncoming flights of the infeed conveyor, the control system accelerates the cutting heads from a dead stop to a pre-determined line speed, or linear velocity in the direction of the path of travel, which is to be matched to the speed of the packaging film drawn downstream over the film forming shoe by the fin seal assembly. During the gradual acceleration of the cutting heads in the direction of the path of travel, the control system of Seko, et al. seeks to synchronize both the motor speeds and phases, i.e. the timing points, of the cutting head drive motor and the fin wheel drive motor to ensure that the article packages are properly formed without otherwise moving the product, and/or packaging film, out of registration with any markings contained on the packaging film. The packaging article inclusion-proofing device of Seko, et al. accomplishes all of these features by detecting the presence or absence of articles within the infeed flights, and by controlling the deceleration and acceleration of the cutting heads on a velocity and timing basis. The device of Seko, et al., however, does not use rotational position control of the respective machine drives as a part of the system.

Another problem that arises in high speed wrapping operations using horizontal wrapping machines is when an article is present within the flights of the infeed conveyor, but is moved into the tube of packaging film so that it is out of registration with a pre-determined position within the packaging film, i.e. it is no longer aligned with any advertising marks, or other markings contained on the packaging film, and which should not otherwise be cut by the cutting heads during package formation. Moreover, the possibility also exists that if this occurs, the articles will be in a position such that they will be cut or damaged by the cutting heads as they are passed therebetween resulting not only in improperly packaged articles, but also damaged articles. This, of course, leads to diminished production efficiency and increases packaging, as well as article, costs. In addition, for example with soft baked foodstuffs, the possibility also exists that were the cutting heads to cut the package with an article in its incorrect position, i.e. cut the article itself, then the cutting heads could become fouled with foodstuffs or other debris, again necessitating machine shutdown and cleaning of the cutting heads.

One approach to solving this problem is disclosed in a second patent to Seko, el al., U.S. Pat. No. 4,955,176, which again uses an upstream sensor in conjunction with a timing mechanism to gradually decelerate, stop, and accelerate the motor drive for the end-sealing mechanism, i.e. the counter-rotating and opposed sealing and crimping heads, to ensure that they do not meet with one another to form a cut in the packaging film, and to seal/crimp the film where an article has been detected out of its proper packaging position. Again, as with the '258 patent to Seko, et al. referenced above, this is done on a timing basis in which the velocity and timing phase of the drive motor for the cutting and sealing heads is matched, as best as possible, to the velocity and timing phase of the infeed conveyor drive, and the film feed drive. Again, however, a rotational position control of these drive motors does not take place.

A second approach to this problem of out of position articles is disclosed in U.S. Pat. No. 4,722,168 to Heaney, which, in fashion similar to the '176 patent to Seko, et al., detects whether a product is out of registration at an upstream point, i.e. ahead, of the cutting heads, such that if the condition is sensed a software routine is called into operation which causes the cutting heads to come to a stop in an open condition, i.e. position, as the packaging film continues to be fed therethrough with the out of position articles, such that the formation of packages is prevented while also preventing damage to the articles contained in the packages, or fouling the cutting heads.

The inventions disclosed in the '176 patent to Seko, et al., as well as the patent to Heaney, are constructed so that the cutting heads will be stopped in an open position for allowing passage of the tube of packaging film, with the articles entrained therein, between the cutting heads. However, a problem resulting from this construction is that as the cutting heads have been stopped in an open position, and the packaging film is allowed to continue along the path of travel, the ability to synchronize or register the position of the cutting heads with respect to the tube of packaging film becomes much more difficult in that speed control is being used rather than controlling the rotary position of the respective drive axes of the wrapping machine. For example, none of the above described patents refers to a control system which is informed of, calculates, and establishes rotational positions of the infeed drive axis, the film feed drive axis, and the cutting head drive axis with respect to one another through all ranges of positions. The known systems which utilize speed controls can perform a similar function of stopping the cutting heads in an open position, but they may not do this as precisely as is needed in order to maintain a high speed uninterrupted flow of packaging operations for providing yet greater efficiency and operation, while lowering production costs still further.

U.S. Pat. No. 4,924,657 to Berti, et al. discloses an otherwise conventional horizontal wrapping machine which appears to utilize position control of the respective drive axes for the infeed conveyor drive, the fin seal assembly drive, and the cutting head drive in order to attain the stated objective of improving the control of the position of the cutting heads with respect to the tube of packaging film moving therethrough. In order to attain this object, the device of Berti, et al. has a circuit arrangement operatively coupled to the cutting and sealing head assembly for regulating the rotational position of the cutting and sealing head drive motor, and a computer, in which the circuit arrangement is housed, which calculates from data received from encoders on the drive motors for the infeed conveyor belt and the fin seal assembly, synchronous rotary positions of the fin seal assembly drive motor and the cutting head drive motor, at least during those periods of time within which the cutting heads are in contact with the packaging film. It appears that the device of Berti, et al. was developed to improve control of the cutting heads, and in particular the epicyclic motion of the cutting heads as they go through periods of relative acceleration, deceleration, and speed matching with respect to the linear speed of the packaging film passing therebetween in the direction of the path of travel.

Although the device of Berti, et aL did therefore provide for improved position control of the respective drive axes for at least some of the drive motors within a packaging machine, Berti, et al. did not attempt to solve the problem of preventing the formation of defective packages on a packaging machine by either preventing the formation of empty packages, or by preventing the cutting heads from cutting the articles to be packaged during package formation when those articles are out of a desired or pre-determined product position within the tube of packaging film.

Therefore, a need exists for an improved article packaging machine which is constructed and arranged to address not only the problems of preventing the formation of empty packages, but which can also prevent the formation of defective packages by severing or cutting the articles and the packaging film tube when the articles are out of position within the tube of packaging film, all in an uninterrupted high speed packaging flow. What is also needed, but seemingly unavailable in the art, is such an improved packaging machine which allows still greater production rates to be attained than those available with the known packaging machines, and which also will allow for higher quality packaging operations by ensuring that when the machine is slowed, or stopped, as needed, throughout the package formation process, that the relative positions of the flights of the infeed conveyor. the markings on the packaging film, and the positions of the cutting and sealing heads remain fixed in pre-determined positional relationships with respect to one another to ensure that the product. and packages, are always in proper registration with respect to one another, and with respect to the cutting and sealing heads, for the formation of acceptable packages, and for minimizing the prospect of having to reject packages for either being empty, and/or for being out of registration with the desired graphics or printed information/labels contained on the packaging film. Moreover, a need exists for such an improved packaging machine which provides for improved production rates, and thus improved operation efficiencies, and lower packaging costs, in a high speed continuous motion packaging operation.

SUMMARY OF THE INVENTION

The present invention provides an improved article packaging machine, and a method of using same, for preventing the formation of empty or defective packages which overcomes some of the design deficiencies of the other known wrapping machines, and wrapping methods, known in the art. The improved article packaging machine, and methods of use disclosed herein minimize the problems of forming empty packages, i.e. packages having no articles contained therein, as well as minimizing the prospects of forming defective packages in which out of position articles can be severed or damaged by the cutting heads, and which may also have registration problems between the markings on the film and the articles in the film, in fashion heretofore unknown in the art. Moreover, the present invention accomplishes these objects at far greater production rates than heretofore known in the art, and with a degree of accuracy and reliability also unknown in the art. In addition, the relative simplicity of construction, ease of use, and reliability of this invention, in comparison with the known wrapping machines, allows for a far greater degree of flexibility in use in that this construction is readily adapted for use with a wide variety of articles and article configurations likely to be encountered on horizontal wrapping machines, and which is constructed to yield a consistently finished high quality packaged article.

The improved wrapping machine and methods practiced by this invention are adapted for use with the known type of horizontal wrapping or packaging machines, the machine being provided with a supply of articles to be packaged, and having an endless infeed conveyor extending along at least a portion of a path of travel which extends through the packaging machine, and is being moved in the direction of the path of travel by an infeed conveyor or first drive. The infeed conveyor, in known fashion, is provided with a series of spaced article receiving flights defined along its length for being supplied with the articles to be packaged. A packaging film forming shoe will be positioned along the path of travel, downstream of the infeed conveyor, for forming a web of thermoplastic packaging film, or other suitable packaging films, as a tube about the articles as they are placed into the tube of packaging film by the flight pins of the infeed conveyor. Thereafter, the now entrained articles are carried by the tube of packaging film toward and between a downstream pair of opposed and counter-rotating sealing and crimping, or cutting, heads positioned along the path of travel, the cutting heads being constructed and arranged to crimp and seal the tube of packaging film about the spaced ends of each successive article package in known fashion. The packaging film is moved toward the packaging film forming shoe by a film feed or second drive, and the cutting heads are rotated in the direction of the path of travel by a cutting head or third drive.

The packaging machine will also be provided with a machine controller, and will include a fin seal assembly positioned intermediate the packaging film forming shoe and the cutting heads, along the path of travel, constructed and arranged to form a conventional fin seal along the continuous side/bottom edges of the packaging film web to thus form the packaging film as a tube about the articles. Thus, the fin seal assembly may be provided with a separate drive if so desired, and may be used to draw the packaging film over the film forming shoe in place of, and as, the film feed drive. The rotational position of each of the respective drive axes, the infeed conveyor drive, the film feed drive, the fin seal assembly drive, if one is provided, and the cutting head drive, are reported to the machine controller, which is constructed and arranged to automate the operation of the packaging machine and rotate the various drive axes with respect to one another, as desired.

In a preferred embodiment of the novel method practiced by this invention, an initial rotational position for each of the infeed conveyor, film feed, and cutting head drives, usually the drive axis, is determined. Thereafter, a base rotational position relationship of the film feed drive and the cutting head drive, with respect to one another, is established, which base relationship is maintained during the operation of the packaging machine. The rotational position of the film feed drive and the cutting head drive, in the aforementioned base position, are mapped to the rotational position of the infeed conveyor drive so that it functions as a master with the film feed and cutting head drives slaved to the rotational position of the master drive. Thereafter, in fashion heretofore unknown in the art, a first position control trajectory profile is calculated, and a first rotational position relationship is established of the film feed and cutting head drives, respectively, with respect to the rotational position of the infeed conveyor drive during packaging operations.

In known fashion, the articles to be packaged are moved along the path of travel within the article receiving flights of the infeed conveyor, and past a detector positioned upstream of the film forming shoe, the detector being constructed and arranged to detect whether an article is present within the flights of the infeed conveyor passing thereby. In response to detecting the absence of an article within a first flight passing by the detector, a second position control trajectory profile is calculated within the machine controller, and replaces the first position control trajectory profile within the machine controller. In response to this, the rotational positions of the film feed and cutting head drives, respectively, with respect to the rotational position of the infeed conveyor drive are retarded to effect a decrease in speed with respect to the speed of the infeed conveyor drive, while maintaining position control over the drives at all times during machine operation.

If an article is detected within a second flight upstream of the first flight by the detector, a third position control trajectory profile is calculated in response thereto, the third profile replaces the second profile within the machine controller, having the effect of advancing the rotational position of the film feed and cutting head drives, respectively, with respect to the rotational position of the infeed conveyor drive. Thereafter, if an article is detected within a subsequent or third flight passing by the detector, the first position control trajectory profile is re-calculated within the machine controller, and replaces the third position control trajectory profile such that the first rotational position relationship of the film feed and cutting head drives, respectively, with respect to the rotational position of the infeed conveyor drive, is re-established.

In the situation where more than one consecutive empty flight is detected during machine operations, a differing third position control trajectory profile will be calculated, and will replace the second position control trajectory such that the film feed and cutting head drives, respectively, are dwelled, i.e. are stopped in a fixed rotational position, with respect to the ongoing rotation, and rotational position, of the infeed conveyor drive. Thereafter, once an article is detected in a subsequent flight a fourth position control trajectory profile is calculated, which replaces the third position control trajectory profile within the machine controller, and in response thereto, the rotational positions of the film feed and cutting head drives, respectively, are advanced with respect to the rotational position of the first drive.

The improved packaging machine of this invention, as well as its method of use, can then restore the packaging machine back to its first rotational position relationship assuming that an ongoing stream of filled article receiving flights is detected by the detector, or if various combinations of a single empty flight, or consecutive empty flights are detected, the machine will automatically calculate the appropriate position control trajectory profiles and will retard, dwell, advance, or restore the respective positional relationships of the drive axes of the packaging machine. This is all done automatically, and allows high speed uninterrupted usage of the machine.

Moreover, in fashion unknown in the art, when a single empty flight is detected, rather than stopping the cutting head drive, and thus the rotation of the cutting heads with respect to one another, as well as stopping the film feed drive and/or a fin seal assembly, for example as is done in the '258 patent to Seko, et al., the cutting heads continue to be rotated in the direction of the path of travel in a separate position control trajectory profile which allows the heads to continue rotating, but on a mapped positional basis with respect to the rotational position of the infeed conveyor drive due to the unique control system provided by this invention, which maps the rotational position of at least the cutting head drive with respect to the rotational position of the infeed conveyor drive.

Toward that end, the invention hereof is also constructed to prevent the formation of defective packages, for example, when an article is detected by a second detector positioned along the path of travel with respect to the fin seal assembly, and upstream of the cutting heads, out of a pre-determined packaging position within the tube of packaging film. Where only a single out of position article is detected, the cutting heads will continue to rotate in the direction of the path of travel, and will not be stopped which thus ensures that the rotational positions of the respective drives remain fixed with respect to one another such that the registration of the packaging film with respect to the sealing and cutting heads, and in particular with respect to the sealing and crimping of the packaging film by the cutting heads, always remains in a desired and controlled position. Thereafter, once an article is detected in the next successive flight in a proper packaging position within the tube of packaging film, a properly formed package is produced in proper registration with the package markings.

Should out of position articles be detected in consecutive flights, the cutting head drive will be dwelled in a fixed rotational position with respect to the rotational positions of the infeed conveyor drive and the film feed drive, which in this embodiment of the invention are set in a base relationship with respect to one another, and to which the rotational position of the cutting head drive is mapped. In fashion similar to the novel method of preventing the formation of empty packages, the second detector will poll the packaging film to determine when a properly positioned article is found within the tube of packaging film, whereupon a new position control trajectory profile is calculated for the cutting heads such that the rotational position of the cutting head drive is advanced with respect to the rotational position of the infeed conveyor drive and the film feed drive. Subsequently, assuming a continuous stream of properly positioned articles is detected within the packaging film tube, the first rotational position relationship of the cutting head drive with respect to the rotational positions of the infeed conveyor and film feed drives is re-established to allow a smooth and uninterrupted packaging stream to be realized at improved production rates, and with diminished reject rates than previously attainable with the known horizontal wrapping machines.

The calculation of the position control trajectory profiles, and the establishment of the rotational position relationships takes place within a machine controller provided as a part of the wrapping machine of this invention. So constructed, the packaging machine of this invention will report to the machine controller the rotational position of each drive it is monitoring, to include at least the infeed conveyor drive, the film feed drive, and the cutting head drive, whereupon the machine controller will then determine the desired rotational position relationships, and position control trajectory profiles, for these drives with respect to one another on a continuing basis during machine operation. The machine controller will emit the desired rotational position control signals, i.e. the implementation of the selected or calculated position control trajectory profiles, to the respective drive motors/axes for maintaining the desired rotational position relationships, advancing certain drives with respect to the others, dwelling certain drives with respect to the others, if need be, in fixed rotational positions, and by advancing the rotational positions of selected drives with respect to other drives, if need be, and as desired in order to implement the smooth and uninterrupted flow of packaging operations on the machine.

Both of the two detectors provided as a part of this invention are adapted to record an input pattern of the articles passing by the respective detector within the flights of the infeed conveyor, or within the tube of packaging film, as appropriate, and signal this data to the machine controller, which in turn will selectively calculate the desired position control trajectory profiles in response to the input patterns so detected. The machine controller first calculates an active position control trajectory profile used to start the machine upon initial operation, and then, in response to the input patterns so detected, or in response to parameters selected during machine operation, or during product changeover, will continuously calculate an inactive position control trajectory profile and will constantly replace the active profile with the inactive profile in a continuous process during the entirety of machine operation. In this fashion, the machine is always maintained under positive control for ensuring still higher production rates with lowered rejection rates than previously available.

It is, therefore, an object of the invention to provide an improved packaging machine, and method of use, which allows for higher production rates than are currently available with the known types of packaging machines.

Another object of the invention is to provide an improved packaging machine, and method of use, which minimizes the waste of packaging film, as well as the waste of articles which may be damaged during packaging operations.

It is another object of the invention to provide an improved packaging machine, and method of using same, which allows for the respective drive axes of the machine, and in particular their rotational positions, to be controlled with respect to one another throughout machine operation in automated fashion for attaining higher production rates, and improved operating efficiencies.

Yet another object of the present invention is to provide an improved packaging machine, and method of using same, which provides for a smoother packaging flow in which the machine is not subject to sudden stops and starts upon encountering an empty article receiving flight.

Still another object of the present invention is to provide an improved packaging machine, and method of using same, which will slow, but not stop, the rotation of the cutting heads in the direction of the path of travel in response to the detection of an empty article receiving flight, or in response to the detection of an article out of a pre-determined packaging position within the tube of packaging film in order to ensure that subsequent articles are correctly positioned and packaged on the machine.

It is also an object of the present invention to provide an improved packaging machine, and method of using same, which will ensure the correct position, and speed, of the packaging film tube, and the articles contained therein, being passed between the cutting heads throughout the course of machine operation, even if the cutting head drive and film feed drive need to be stopped during machine operation.

Another object of the present invention is to provide an improved packaging machine, and method of using same, which is simple in design and construction, is easy to use, and which is rugged and durable in structure and in use.

The present invention accomplishes these objects, among others, while providing for flexible, efficient, and continuous high speed packaging operations in horizontal wrapping machines. Therefore, other objects, features, and advantages of the present invention will become apparent upon reading the following specification, when taken in conjunction with the accompanying drawings.

DETAILED DESCRIPTION

Figure 1:
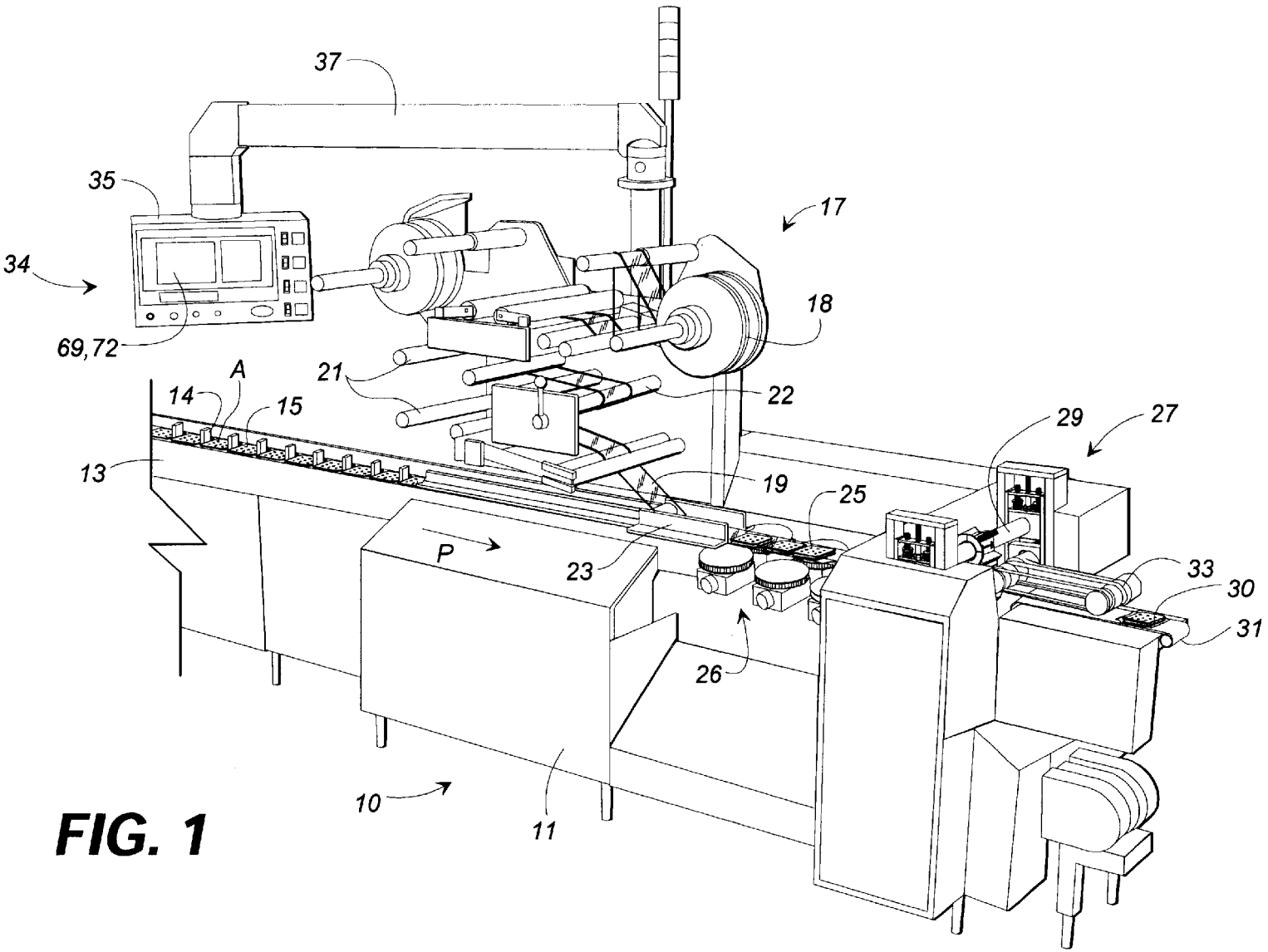
FIG. 1 is a perspective view of a horizontal wrapping machine with which the invention hereof may be used.

Referring now to the drawings, in which like reference characters indicate like parts throughout the several views, numeral 10 of FIG. 1 illustrates generally a horizontal wrapping machine of a type known in the art. Wrapping machine 10, for example, may include the MACH 3 series of horizontal wrapping machines manufactured by Food Machinery Sales, Inc., of Athens, Ga. as disclosed more fully in U.S. Pat. No. 5,678,390, entitled Horizontal, Form, Fill, and Seal Packaging Machine, the provisions of which are incorporated herein by this reference. Wrapping machine 10 thus has a cabinet style framework 11 extending from an infeed, or upstream end, and extending along a path of travel, denoted by the reference character "P", toward a downstream or discharge end of the packaging machine.

Supported on the infeed end of the packaging machine is an elongate endless infeed conveyor 13 containing a series of spaced timing pins 14, which form a series of spaced article receiving flights 15 along the length of the conveyor. The articles to be packaged, denoted by the reference character "A", will be placed within the respective flights of the infeed conveyor by an upstream article supply magazine (not illustrated), or other article placement device (not illustrated) constructed and arranged to place either a single article, or a stacked plurality of articles, respectively, within the flights of the infeed conveyor.

Situated downstream of the infeed conveyor, and supported on the framework 11 of the packaging machine, is a packaging film assembly 17 having at least one, and in this instance two, rolls 18 of a packaging film 19. Packaging film 19, also referred to as the "paper" by those skilled in the industry, may comprise a thermoplastic packaging film or other types of packaging films to include paper if so desired, all of which are intended for use with horizontal wrapping machines, and which will be sealed by melting or fusing the opposed sides/bottom edges of the film web together to form a tube, and later a package, about the articles.

As shown in FIG. 1, therefore, the packaging film 19 is drawn off of roll 18 and passed over a series of idler rollers 21, and over a drive roller 22 constructed and arranged to draw the film off of roll 18, and move it toward a downstream film forming shoe 23 constructed and arranged to form the packaging film as a tube 25 of packaging film about the spaced articles as they are passed from the respective flights of the infeed conveyor into the tube of packaging film at the film forming shoe.

After being placed into the tube of packaging film, the tube of packaging film and the entrained articles are then passed over a fin seal assembly 26 which is constructed and arranged to form a fin seal, in known fashion, along the spaced, elongate side or bottom edges of the packaging film web to complete formation of the tube packaging film. Although not disclosed in greater detail herein, it is known to those skilled in the art that a separate film feed drive need not be provided, and that the fin seal assembly, only, can be used for drawing the packaging film off of roll 18, and over film forming shoe 23 to form the tube of packaging film. In known fashion, therefore, fin seal assembly 26 includes at least one opposed and counter-rotating pair of fin seal wheels which will be heated for forming a bottom fin seal in the tube of packaging film.

Thereafter, and in known fashion, the tube of packaging film is directed toward a downstream cutting head assembly 27 constructed and arranged to crimp the open ends of the tube of packaging film formed about the spaced ends of each article, group of articles, or stacked articles, and to seal the package about the articles by forming a heat seal at the spaced ends of each article package so formed. This is accomplished by rotating a pair of opposed and counter-rotating cutting heads 29, one of which is illustrated in FIG. 1, in positional relationship, i.e. independent of time and speed, with one another such that the knife (not illustrated) of a first cutting head will be engaged on the anvil (not illustrated) of the opposed cutting head. The flank surfaces of the cutting heads will be heated and will form a heat seal at the spaced ends of the article package. The now packaged articles 30 are then passed onto a discharge conveyor 31 moving along the path of travel, which may also include the use of an overhead conveyor 33 to ensure that the packages lay flat as they are passed from the cutting head assembly on to the discharge conveyor.

Also shown in FIG. 1 is a machine controller 34 positioned in a housing 35, the housing being carried on a support arm 37, the support arm in turn being supported on framework 11 of the packaging machine.

Figure 2:
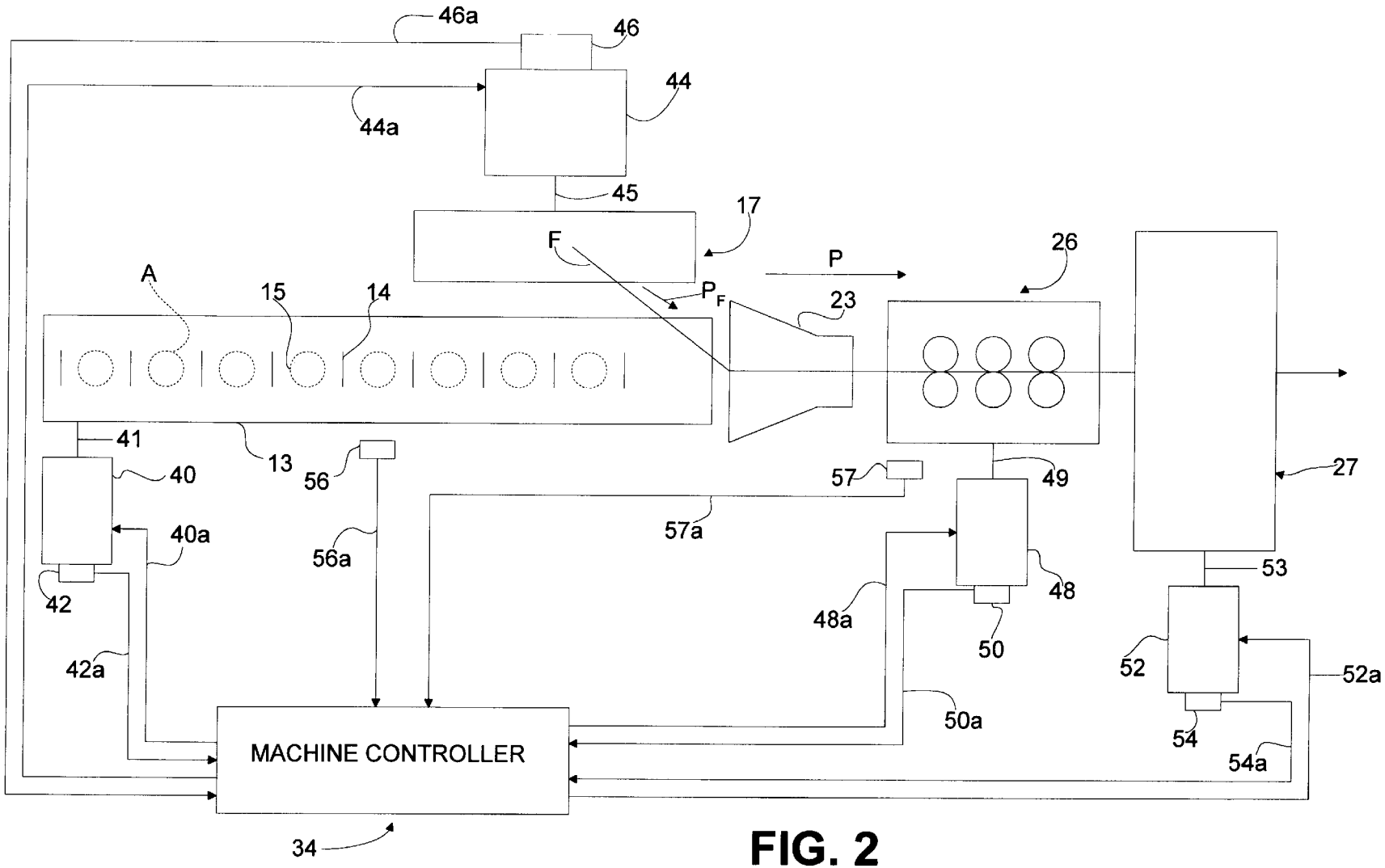
FIG. 2 is a schematic illustration of the packaging machine of FIG. 1 illustrating the respective drive axes of the wrapping machine in communication with the machine controller of the packaging machine.

FIG. 2 schematically illustrates the packaging machine of FIG. 1, and in particular the drive system, and the machine controller/control system, associated therewith. Accordingly, infeed conveyor 13 is provided with an infeed conveyor drive servo motor 40 having a drive axis 41, the drive axis being fastened to a conventional drive train (not illustrated) constructed and arranged to drive infeed conveyor 13 in the direction of the path of travel, P, as shown. Drive motor 40 includes a feedback device 42, which may be either an encoder, or a resolver, as desired. As referred to hereinafter, the terms "encoder" or "resolver" may be used interchangeably and both denote a feedback device constructed and arranged to signal the rotational position of the respective drive motor/axis with which such a feedback device is associated, to machine controller 34. Accordingly, feedback device 42 has a signal path 42*a* in operative communication, i.e. hard wired, with machine controller 34, as illustrated in greater detail in FIG. 3. Similarly, drive motor 40 is hard wired to machine controller 34 through a signal path 40*a* leading away from the machine controller.

Still referring to FIG. 2, packaging film assembly 17 is provided with a film feed drive servo motor 44, having a drive axis 45 operatively fastened, in known fashion, to drive roller 22 (FIG. 1) of packaging machine 10. Drive motor 44 communicates with machine controller 34 through a signal path 44*a*. Drive motor 44 includes a feedback device 46, which itself communicates with machine controller 34 through signal path 46*a*.

Fin seal assembly 26 is provided with a fin seal assembly servo drive motor 48, having a drive axis 49 engaged with a drive train (not illustrated) which rotates at least one pair of fin seal wheels in counter-rotating fashion, and in the direction of the path of travel, for forming the fin seal along the bottom edges of the packaging film as it is formed as a tube about the articles. So constructed, fin seal assembly 26 is otherwise conventional, and is not illustrated in greater detail herein. Drive motor 48 communicates with machine controller 34 through a signal path 48*a*, and includes a feedback device 50, which itself communicates with machine controller 34 through a signal path 50*a*.

Finally, cutting head assembly 27 also has a drive motor, cutting head assembly servo drive motor 52, having a drive axis 53 which is fastened to a drive assembly (not illustrated) of conventional construction, such that the two cutting heads 29 (FIG. 1) counter-rotate with respect to one another, and in the direction of the path of travel for forming the end seal and crimp in each respective package as it is passed therebetween. Drive motor 52 thus has a signal path 52*a* to machine controller 34, and includes a feedback device 54, having a signal path 54*a* in communication with the machine controller.

Also shown in FIG. 2 is a first detector 56 positioned upstream of the film forming shoe and along the path of travel with respect to the infeed conveyor for detecting whether an article A is present within each of the flights 15 of infeed conveyor 13 as they are moved thereby in the direction of the path of travel. Detector 56 communicates with machine controller 34 through signal path 56*a*. A second detector 57 is positioned along the path of travel above, or alongside, fin seal assembly 26 for detecting whether an article is present at a pre-determined location/position within the tube of packaging film, or present in an out of position location, as desired, and communicates this data to machine controller 34 through signal path 57*a*. First and second detectors 56, 57, respectively, will each be an optical detector which emit beams of light that are interrupted when articles pass therethrough. Also, detector 56 may double as detector 57, if so desired. Other types of detectors may also be used, if desired, so long as these detectors are constructed to detect the presence of a physical article moving thereby.

Each of signals paths 40*a*, 42*a*, 44*a*, 46*a*, 48*a*, 50*a*, 52*a*, 54*a*, 56*a*, and 57*a* may be conventional hard wired signal paths such that a wire capable of transmitting electrical signals therethrough to and from machine controller 34 is present, or may comprise fiber optic cables, or other data transmitting means, as desired, and/or as developed for future use in the controls field. Also, although encoders 42, 46, 50 and 54 are shown as being fastened to, or formed as a part of motors 40, 44, 48, and 52, respectively, the encoder for each drive axis could be mechanically geared or driven by their respective machine components, for example infeed conveyor 13 could mechanically drive encoder 42, for reporting the rotational position, or signal data which can be used to calculate the rotational position of the respective "drives" within machine controller 34 in lieu thereof. Also, and in lieu of encoders on the respective drive motors as position feedback devices, resolvers or other known types of feedback position devices may be used. For example, and not by way of limitation, an indexing or timing disc could be affixed to the respective drive axes having an indexing mark used with optical sensors/detectors to detect and signal the position, preferably the rotary position, of the respective drive axes.

Figure 3:
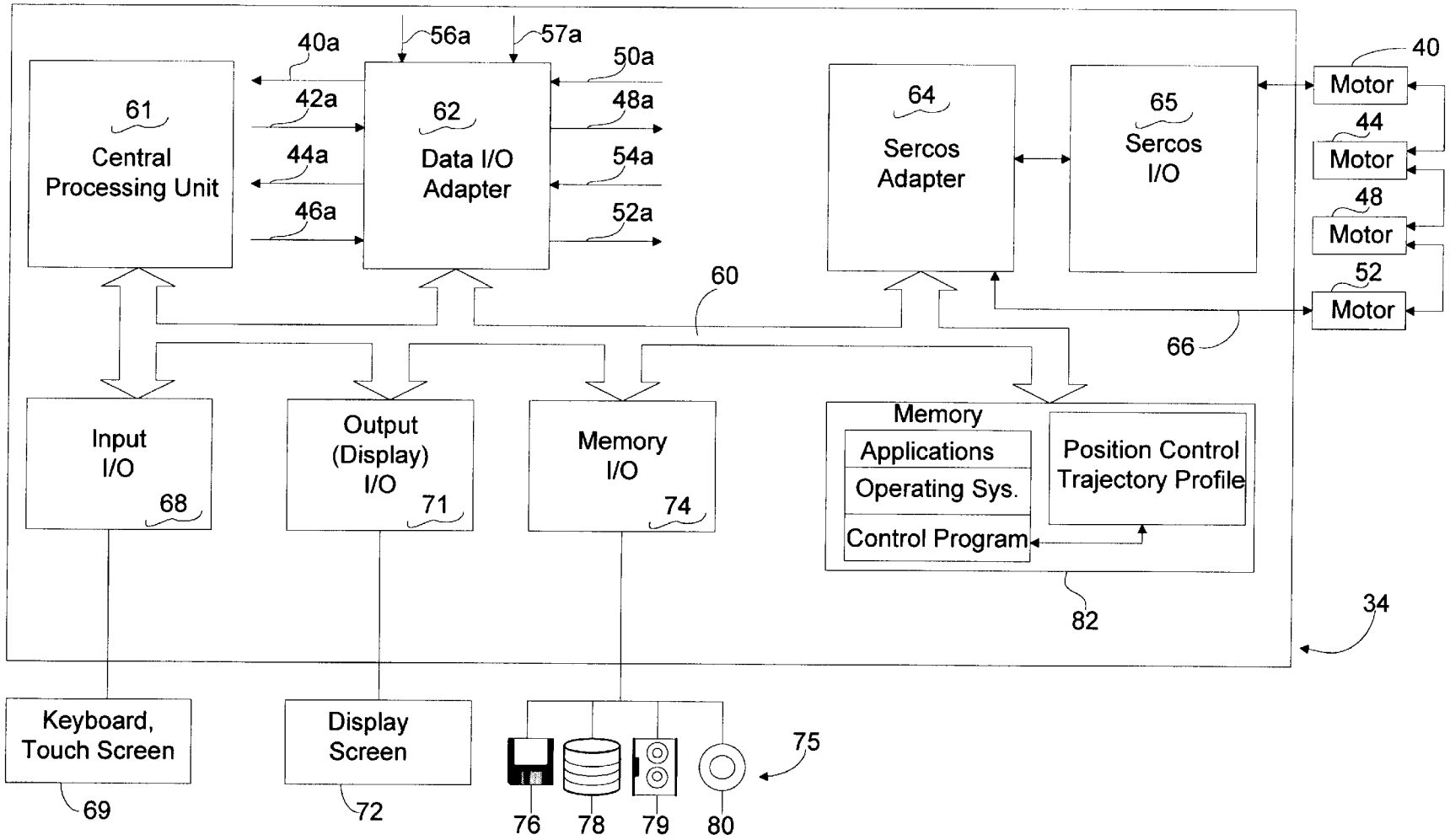
FIG. 3 is a schematic illustration of the improved machine controller of this invention.

Machine controller 34 is schematically illustrated in FIG. 3. Machine controller 34 comprises a computer, having a two-way data bus 60 in communication with each one of the components of the computer. These components include a central processing unit 61, a data input/output adapter 62, a SERCOS adapter 64 in two-way communication with a SERCOS input/output board 65, an input board 68, an output board 71, a memory board/controller 74, and an internal memory 82. Data input 68 is in communication, i.e. it is hard wired, or otherwise receives signals indicative of prescribed or desired data parameters, from a data input source, for example a keyboard or touch screen 69, also illustrated in FIG. 1. Output board 71 communicates with a data display screen 72, also shown in FIG. 1. Memory controller 74 may communicate with any type of known computer memory storage device 75, to include a floppy disk 76, a hard disk drive 78, digital tape 79, as well as a CD ROM/DVD 80. Each of memory storage devices 76, 78, 79, and 80, also includes the appropriate memory drive device, for example floppy disk drive, a tape drive, or a CD/DVD reader, as known, to enable operation of the device.

Memory 82 may comprise a RAM, or random access memory portion, as well as a ROM, or read only memory portion. Moreover, the ROM portion may comprise an EEPROM, or other pre-programmed memory card in communication with bus 60, to include a separate EEPROM card reader, although not illustrated in FIG. 3. So constructed, memory 82 will include the necessary operating system, as well as additional applications programs, and the control program(s) used to control the operation of packaging machine 10 in the claimed fashion, and as described in greater detail later below. As a portion of its operations discussed in greater detail below, the control program constantly calculates a position control trajectory profile, as shown in FIGS. 4A, B, and in FIG. 5, storing an active position control trajectory profile in memory, and constantly calculating an inactive position control trajectory profile which replaces the active position control trajectory profile, as shown in FIG. 5, all throughout machine operation.

As shown in FIG. 3, data input/output adapter board 62 receives, or is the origination point, of the respective signal paths 40*a*–57*a*. SERCOS adapter 64, and SERCOS input/output board 65 are provided as part of a SERCOS fiber optic control loop 66, which is in two-way communication with each of drive motors 40, 44, 48, and 52, illustrated schematically in FIG. 3. SERCOS stands for Serial Real-Time Communication Standard, and refers to the standard by which the SERCOS fiber optic loop is constructed. The operating system housed within memory 82 comprises the iRMX operating system developed by Intel Corporation, and which is a realtime multi-tasking operating system. SERCOS was developed by Pacific Scientific Electric, a manufacturer of servo drives. Pacific Scientific also provides an SRX program, which stands for SERCOS Run Time Executive, which runs as the main task under iRMX. SRX provides the capability of communicating data over Ethernet networks to data collection systems, such as Windows DDE (dynamic data exchange) programs, such that the packaging machine 10 shown in FIG. 1 may be networked to a larger network of other packaging machines, or to a packaging line, as well as being networked to all devices throughout the entire packaging facility within which the packaging machine is placed, and in which other similar packaging machines may be placed. Another operating program housed within memory 82 includes the AML® motion control language developed by Pacific Scientific Company of Newport Beach, Calif. AML® is a computer software program designed for use with motion control systems, and uses a multi-tasking operating system, here iRMX, and the SERCOS SRX system, for performing multi-tasking control of event driven and object oriented applications, and is used in controlling the rotational position of the respective drives shown in FIGS. 2 and 3. Thus, as shown in FIGS. 2 and 3, packaging machine 10 is a multi-axis servo driven machine providing state-of-the-art operation and control, and is particularly well suited for use with the novel features of this invention. Although the iRMX and SRX software systems are described herein, it is anticipated that any known software program and/or operating system may be used if it is capable of being adapted to performing the tasks described hereinbelow.

Figure 4A:
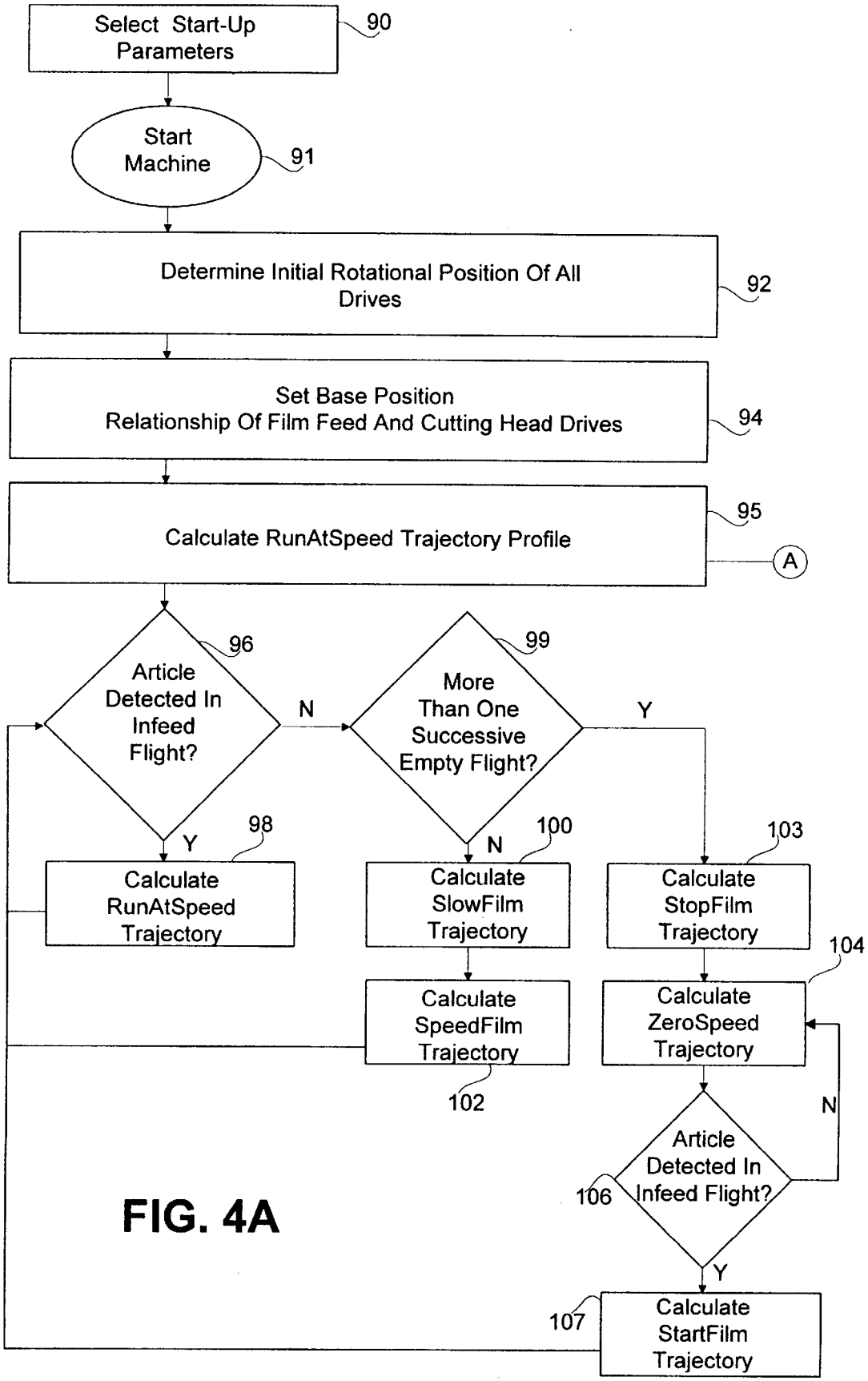
FIG. 4A is a flow chart of a first embodiment of the improved process practiced by this invention.

FIGS. 4A and B are flow charts of the control logic followed by the control program within memory 42, and executed by central processing unit 61 within machine controller 34 during machine operation. Each of blocks 92–107 in FIG. 4A blocks 192–307 in FIG. 4B, as well as blocks 110–116 in FIG. 5, represent blocks of executable program code in any desired programming language, to include the AML, control language, as well as other software/control languages desired, and which can accomplish the stated objectives of automating the operation of this machine in accordance with the processes described in greater detail below.

Referring now to FIG. 4A, known as a no product-no cut process, prior to machine startup the machine operator will select those start-up parameters desired for the articles to be packaged. Such information can include the dimensions of the article, the number of articles to be placed within each flight, the dimensions of the package, to include height, length, and width, operating speed, the line speed of the infeed conveyor 13, the pitch or distance between articles, and other known data parameters commonly associated with the operation of a horizontal wrapping machine. Once this is done, the machine operator will start the machine by pressing a start button (not illustrated) situated on housing 34 (FIG. 1). Once the machine starts, machine controller 34 starts operations by determining an initial rotational position of each drive motor 40, 44, 48, and 52 as shown in step 92, although the novel control method of this invention only takes into account the rotational positions of drive motors 40, 44, and 52. It is not anticipated that the rotational position of drive motor 48 will be needed in order to accomplish the objects of this invention, although this can be taken into account in the control program when, and as desired. If packaging film assembly 17 is not provided with a separate film feed drive motor 44, as shown, then in this instance the rotational position of fin seal assembly drive motor 48 would be taken into account for use in performing the method disclosed in FIGS. 4A and B, and in FIG. 5.

After the initial rotational position of all the motors or drives is determined in step 92, the rotational positions being signaled to machine controller 34 by the respective feedback devices 42, 46, 50, and 54, the control program sets a base rotational position relationship of the film feed drive motor 44 with respect to the cutting head drive motor 52 in step 94. This base relationship stays in place between these two drives throughout the packaging operations performed by the machine. Both the film feed drive motor and the cutting head drive motor are mapped with respect to the other, and then both of these drive motors are then mapped, or slaved, with respect to the rotational position of the infeed conveyor drive motor 40 as the master.

After these initial rotational positions, and the base position relationship have been determined and established, the first position control trajectory profile is calculated in step 95, identified in FIG. 4A as the RunAtSpeed trajectory profile, which represents a one-to-one position relationship with respect to the rotational position of the infeed conveyor drive motor 40, with respect to the rotational positions of film feed drive motor 44, and cutting head drive motor 52. This ratio, of course, is also a function of the drive train mechanisms used to operate the respective components of the machine driven by these drives. Accordingly, for every increment drive motor 40 rotates its drive axis 41, drive motors 44 and 52 increment their drive axes 45, 53, respectively, in an identical amount so that they are in the same relative rotational position as is drive axis 41. This also assumes that the drive trains (not illustrated) for the infeed conveyor 13, the packaging film assembly 17/drive roller 22, and for the cutting head assembly 26 are constructed to move the articles A, the packaging film 19, the tube 25 of packaging film, and rotate cutting heads 29 in the direction of the path of travel at the same linear rate of speed when the respective drive motors 40, 44, 48 and 52 are being rotated in accordance with the RunAtSpeed profile.

At this point, detector 56 is polled in step 96 by a programmable limit switch (not illustrated) provided as a part of the control program housed within memory 82, to determine whether an article A is present within the respective flights 15 of the infeed conveyor moving along, and in the direction of the path of travel toward the downstream end of the packaging machine. If an article is detected in the infeed flight, the RunAtSpeed trajectory is re-calculated in step 98, and the program loops back on itself to the decisional block at step 96, and will continue to do so until such time an article is no longer detected in the infeed flight, or flights, or the machine is stopped.

Assuming an article is not detected in at least one infeed flight by detector 56 in step 96, the program then proceeds to determine whether there is more than one successive empty flight in step 99. If detector 56 has found that there is only a single empty flight, as shown for example in FIG. 6A in which flight 1 is indicated as not having an article A therein, the program proceeds to step 100 and calculates a SlowFilm trajectory in which the relative rotational position of film feed drive motor 44 and cutting head drive motor 52 are retarded with respect to the rotational position of infeed conveyor drive motor 40, however the drive axes 45 and 53 are not stopped. Accordingly, cutting heads 29 (FIG. 1) will continue to rotate in the direction of the path of travel, although at a slower linear rate of speed along the path of travel than the linear rate of speed of infeed conveyor 13. By retarding the rotation of drive axes 45 and 53 on a 1:1 basis with respect to one another, and preferably at a 1:2 relationship with respect to the rotation of drive axis 41, the film will continue to be advanced toward film forming shoe 23 such that the next subsequent article A within the next upstream flight 15, flight 2 in FIG. 6A, of infeed conveyor 13 is allowed to be advanced toward and into the film forming shoe and the tube of packaging film so formed, without the creation of an empty package which will then be sealed and crimped, and which later will have to be removed from the packaged articles produced by the packaging machine.

Figure 6A:
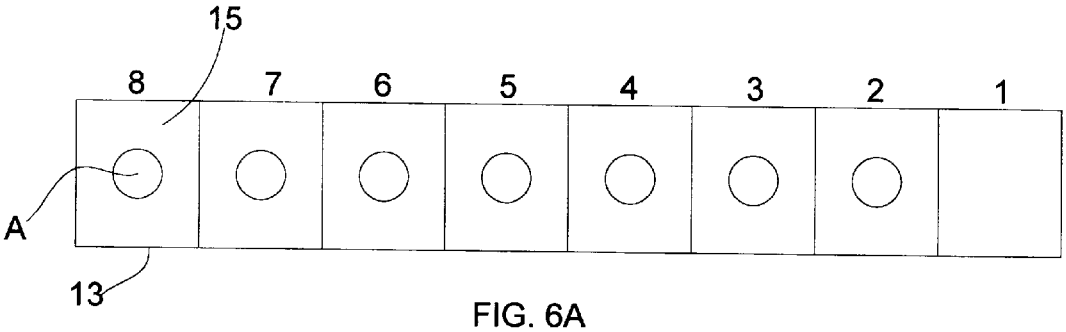
FIGS. 6A–E are alternative schematic illustrations of the infeed conveyor belt, and articles received within the flights thereof, of the packaging machine of FIG. 1 with which the improved packaging machine of this invention may be used.

As only a single empty pocket was detected, as shown in FIG. 6A, and the subsequent upstream pockets are all filled, machine controller 34, and in particular central processing unit 61, then calculates a SpeedFilm trajectory, a third position control trajectory profile which has the effect of advancing the rotational positions of drive axes 45 and 53 with respect to the rotational position of drive axis 41, such that rotation of drive axes 45 and 53 are accelerated with respect to the rotation of drive axis 41 to ensure that as the next subsequent article A is passed into the tube of packaging film between the cutting heads, that the package is sealed and crimped at the proper position in registration with the article, and/or the package markings. Thereafter, the program loops from step 102 back to step 96 to determine once again whether an article is within each of the respective upstream infeed flights until such time as another empty article receiving flight is found.

Figure 6B:
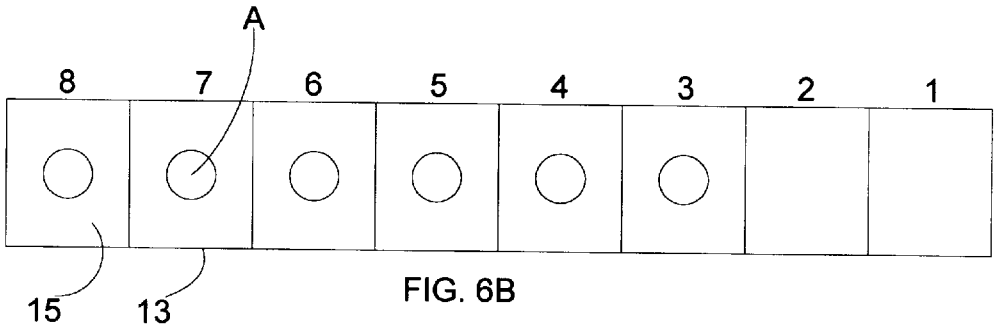

Assuming in step 99 that more than one successive empty flight is found, such as shown in FIG. 6B, the program then proceeds to step 103 in which it calculates a StopFilm trajectory which has the effect of retarding the rotational position of drive axis 45, and drive axis 53, each in a 1:1 relationship with respect to the other, with respect to the rotational position of drive axis 41. Unlike the calculation of the SlowFilm trajectory in step 100, however, the StopFilm trajectory will provide a greater deceleration rate than that provided by the SlowFilm trajectory as the machine will then move into a ZeroSpeed trajectory, calculated in step 104, and shown in FIG. 7B, as a zero velocity curve in which the rotational position of drive axes 45 and 53 are stopped in a fixed rotational position with respect to the other, and are awaiting an instruction from machine controller 34 with regard to the rotation of drive axis 41 in order to synchronize their rotational positions with the rotational position of drive axis 41. Accordingly, in step 106 the program executes a sub-routine of polling detector 56 to look for a next subsequent upstream article, as would be indicated in flight 3 of FIG. 6B, whereupon the machine controller then calculates a StartFilm trajectory in step 107, the StartFilm trajectory providing a slightly greater rate of acceleration than that provided by the SpeedFilm trajectory calculated in step 102, shown in FIGS. 7B and 7A, respectively, for ensuring that the cutting and sealing heads seal and crimp the article(s) at the desired location, i.e. in proper registration with the article and the film. Thereafter, the program loops back to step 96.

Figure 6C:
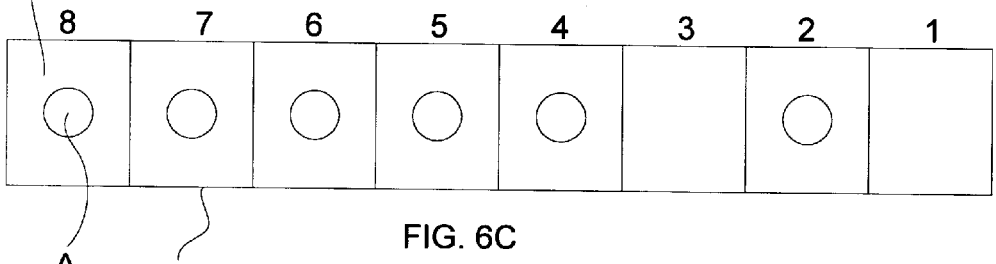
Figure 6D:
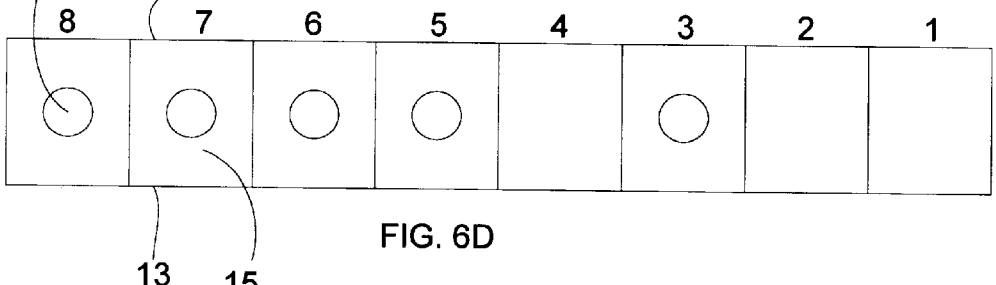
Figure 6E:
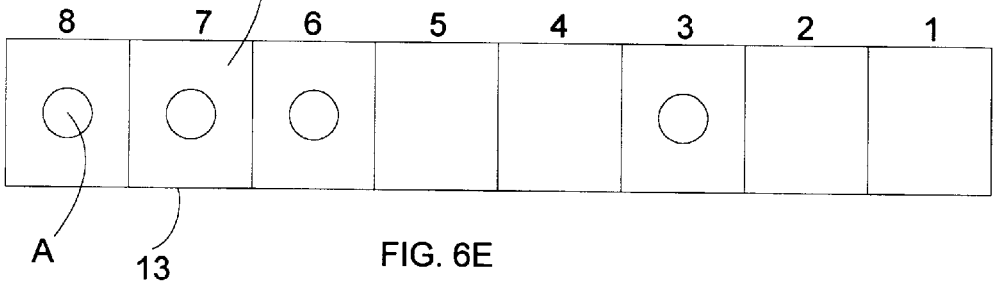

So constructed, a degree of flexibility heretofore unattainable in the art is provided in that the machine will automatically detect, and compensate for the absence of a single article, or the absence of several articles, in any combination which may result in packaging operations, such combinations being reflected in FIGS. 6C, 6D, and 6E.

For example, where an article arrangement such as shown in FIG. 6C is detected by article detector 56, steps 96, 99, 100, and 102 would be performed twice until the article in flight 5 is detected by article detector 56, whereupon step 98 of calculating the RunAtSpeed trajectory, is performed. In similar fashion, where the article configuration in FIG. 6D is encountered, steps 96, 99, and 103–107 would be performed once, after which steps 96, and 99–102 would be performed once, until the article in flight 6 was detected, whereupon step 98 would be performed to calculate the RunAtSpeed trajectory once again. Lastly, for the article configuration shown in FIG. 6E, steps 96, 99, and 103–107 will be performed twice, i.e. two subsequent loops, until the article in flight 7 is detected, whereupon step 98 will be performed in response to the query in step 96, such that the RunAtSpeed trajectory control profile would be calculated to result in the 1:1 mapped rotational position relationship of the film feed drive 44 and cutting head drive 52 with respect to the infeed conveyor drive 40 is resumed.

The flow chart of FIG. 5 illustrates the calculation of the active trajectory control profile, and the calculation of the inactive trajectory control profile, and the continual replacement of the active profile with the inactive profile until such time as the machine is stopped. Although this is shown in FIGS. 4A and B as being associated with steps 95, 295, respectively, the same method of calculating an active profile, and replacing it with an inactive profile, occurs throughout operation of the packaging machine at each step in which a trajectory control profile is calculated, which thus would include not only step 95, but steps 98, 100, 102, 103, 104, and 107 in FIG. 4A, and steps 298, 300, 302, 303, 304 and 307 in FIG. 4B. Although the calculation of a number of different trajectory control profiles is illustrated in FIGS. 4A and B, and discussed herein, these steps can also be thought of as calculating electronic cam tables "on the fly", i.e. during machine operation, for controlling the rotational positions of the several drive axes with respect to one another. Rather than mechanically linking or gearing all of the drives to one another, which can be done if all are powered off of a central (main) drive shaft, the drives are electronically "geared" to one another, and the several trajectory control profiles yield separate cam tables which map the rotational positions of selected drive axes to the "master" rotational position of other selected drive axes throughout their respective ranges of motion, and throughout the several scenarios that may be encountered during machine operation, as shown schematically in FIGS. 6A–E.

During the operation of a horizontal wrapping machine of the type disclosed in FIG. 1, four distinct wrapping phases occur during each cycle in which an article, or article group, is wrapped. These four phases are a first sealing or cutting phase during which the first end seal in the tube of packaging film about the article is made, the return stroke of the mechanism for preparing to make the second end seal, engagement with the film during the sealing/crimping process, and lastly a second sealing/cutting phase in which the sealing and crimping heads form the second end seal and crimp at the second end of the article. The first two phases, the first sealing/cutting phase and the return stroke phase are typically considered together as a single phase. Therefore, there are at least three distinct profile segments that need to be calculated to generate the cam table that will connect the four transition or way points, equal to the four phases described above. An equation is used to generate the master and slave points of the cam profile. To be able to specify the respective positions, as well as the velocity and acceleration of the drives at the beginning and end of each path segment, a quintic polynomial equation is used. This equation would appear as:

$$s=a_0+a_1m+a_2m^2+a_3m^3+a_4m^4+a_5m^5$$

In this equation, s=the slave position, and m=the respective master position for each one of the master points, or drives. The coefficients $a_1$, $a_2$, $a_3$, $a_4$, and $a_5$ are coefficients for line segments that fulfill the desired constraints. Each line segment would have an equation with different $a_0$, $a_1$, . . . coefficients. In addition, it must be kept in mind that other algorithms are available for computing smooth functions, i.e. velocity and/or position profiles, which pass through a given set of data points.

Figure 4B:
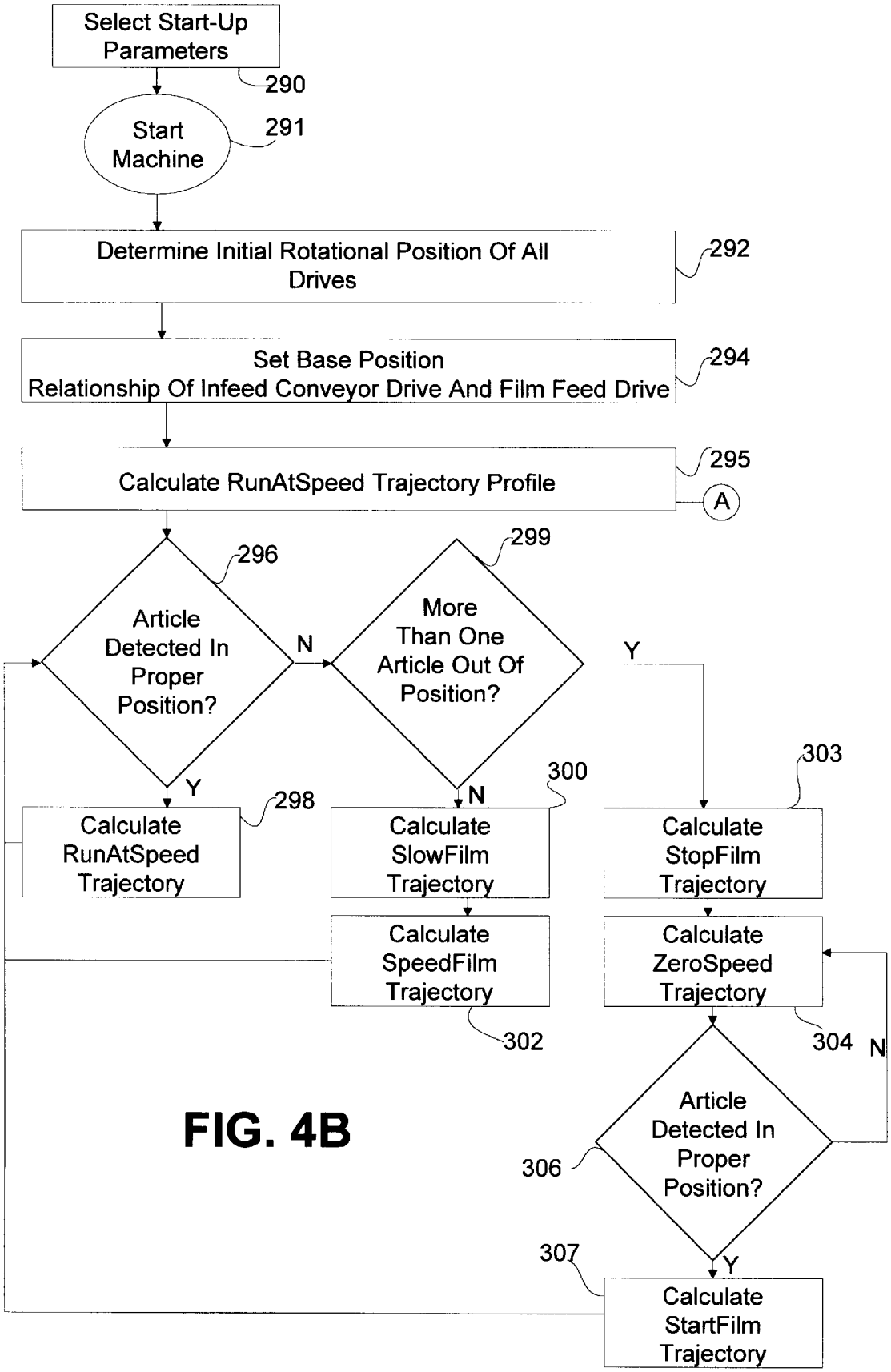
FIG. 4B is a flow chart of a second embodiment of the improved process practiced by this invention.
Figure 5:
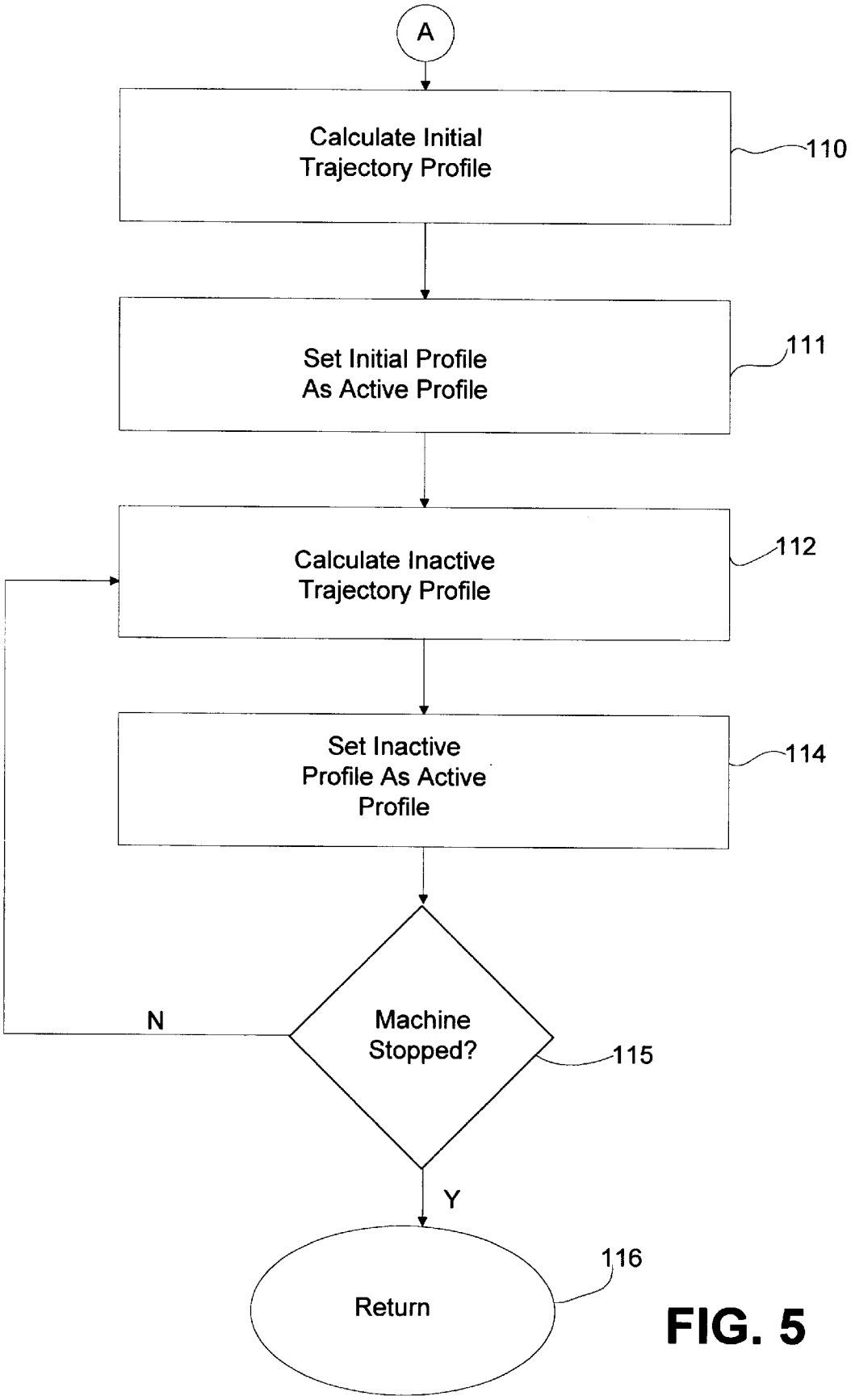
FIG. 5 is a flow chart of a sub-routine practiced by the processes of FIGS. 4A & B.

Here, not only does the machine controller 34 (FIGS. 2, 3) calculate this equation on a continuous basis for constantly updating the segments that will fill the desired performance constraints, but the machine controller is also replacing an active profile (equation) with an inactive profile on a continuous basis, as shown in FIGS. 4A, 4B, and 5. In so doing, the machine controller will modify the return stroke phase of the cycle, which is the phase in which the sealing and crimping heads are not in contact with the packaging film. In order to accomplish this, however, it is important that in generating successive trajectory/position profiles, that the line segments, or phases, for the first sealing and cutting phase, the engagement phase, and the second sealing and cutting phase, are not altered so that a proper seal and crimp is formed at each end of the package. Also, as the articles enter the packaging film, the film should be at the correct position with respect to the articles passed therein from the infeed conveyor. This is done as a part of the wrapping machine setup prior to the automated operation of the machine, in which the distance of the opening of the film tube, i.e. where it is formed as a tube about the articles at the film forming shoe, is established with respect to the position of the cutting heads along the path of travel.

Here, the control philosophy focuses on modifying the return stroke phase to accomplish the deceleration and acceleration of the cutting head drive motor 52 while maintaining a synchronous control of all the other drive motors, 40, 44, and 48 (if provided). The control method of this invention, therefore, provides the capability of being able to change from a current active profile to a second standby profile instantly, without otherwise altering the fixed parameters of the cycle operation. As a part of this process, therefore, the machine controller calculates the required cam tables on a "just in time" basis, for use.

As used herein, the phrase cam table is also the equivalent of a cam profile, and this describes the exact synchronous control of a slave axis with respect to a master axis. For example, the control of drive axis 53 with respect to the master drive axis 41 associated with the infeed conveyor drive. The four phases described above are each line segments, which together form the cam table. The data points represent an ordered pair of master and slave positions within the cam table, there being a slave position defined for each master position. The way points are the master and slave positions at each phase transition point, connecting the path segments, equivalent again, to the four phases of the cyclic wrapping operation. The constraints used in the above-referenced equation are the information needed to solve the equation, which here means the way points of the master position, the slave position, the speed of the master and the slave, and the acceleration of the master and the slave, all of which must be defined to calculate the quintic equation coefficients. The trajectory, or cam profile, is at least one cam profile, as well as multiple consecutive cam profiles, which connected together to form a trajectory as defined by the master and slave positions with respect to one another. See, for example, FIGS. 7A and B. Since it is possible to create a cam table that is more than one cycle in length, it is therefore referred to as a trajectory.

For step 95 however, an initial trajectory control profile is determined as the machine is just commencing operation, and this would be the calculation of the RunAtSpeed trajectory profile. This initial profile is set as the active profile in step 111. Thereafter, an inactive trajectory control profile is calculated in step 1 12, the inactive profile is set to the active profile in step 114, and in step 115 the control program queries the machine as to whether machine operation is stopped, and if not, the program loops back on itself to step 112 to calculate the next inactive trajectory control profile, and continues replacing active with inactive profiles until such time as in step 115 the program has detected that packaging machine 10 has stopped operation. In step 104, however, where a ZeroSpeed trajectory has been calculated so that drive axis 45 and drive axis 53 of the film feed and cutting head drives, respectively, are dwelled in fixed rotational positions with respect to the rotational position of drive axis 41, the active/inactive trajectory control profile exchange does not occur as the already calculated ZeroSpeed trajectory continues to be used while awaiting a signal from article detector 56 that a subsequent upstream article is received within one of the flights 15 of infeed conveyor 13, at which point the StartFilm trajectory is calculated. The sub-routine of FIG. 5 will thus calculate the RunAtSpeed, SlowFilm, StartFilm, StopFilm, ZeroSpeed and StartFilm trajectory control profiles, respectively, in FIGS. 4A and 4B.

In a second embodiment of the invention, the control process of FIGS. 4B and 5 can be used for what is known as a no gap-no seal method of machine control, which is best suited for use with an article out of a predetermined article position within the tube of packaging film, and will prevent the cutting heads from severing the articles and/or sealing and crimping of the article package at a position in which the article is out of registration with either a pre-deterrnined position within the tube of film, for example, or the markings on the film. In this instance, however, in step 294 when the base position relationship is being set, the base position relationship is established between the rotational position of infeed conveyor drive motor 40 and film feed drive motor 44, which are mapped to one another on a 1:1 relationship, whereupon cutting head drive motor 52 is slaved, or mapped, to the base relationship of the infeed conveyor and film feed drives.

Thereafter, the RunAtSpeed trajectory is calculated in step 295, and drive axis 53 of the cutting head assembly 27 rotates at a 1:1 rate rotation positional relationship with respect to the rotational position of drive axes 41 and 45 for the infeed conveyor and film feed drives, respectively. Here, however, article detector 57 is polled by a programmable limit switch (not illustrated) provided as a part of the control program stored within memory 82 of the machine controller such that rather than detecting the presence of an article within the flight(s) of the infeed conveyor in step 296, the step of determining whether an article is present in a predetermined position within the tube of packaging film is performed. If so, the RunAtSpeed trajectory is re-calculated in step 298, and the program would loop back on itself until such time as an article is detected to be in a position other than a desired position within the tube of packaging film.

In this instance, in step 299, rather than looking for more than one successive empty flight, the control program, through the programmable limit switch provided as a part thereof, would poll detector 57 to determine if there was more than one successive, or consecutive, article out of a pre-determined packaging position within the tube of packaging film, i.e. out of registration with the film markings or in a position such that it would be severed or damaged by the cutting heads. If more than one out of position article is found, then steps 303–307 would be performed whereupon a StopFilm trajectory would be calculated in step 303, and a ZeroSpeed trajectory would be calculated in step 304. Detector 57 would be polled in step 306 to determine when the next subsequent article in the proper packaging position, or pre-determined position, within the tube of packaging film is found, whereupon step 307 would be performed of calculating the StartFilm trajectory.

If in step 299 only one article is found to be out of position within the tube of packaging film, the SlowFilm trajectory would be calculated in step 300, and the SpeedFilm trajectory would then be calculated in step 302. Thus, although FIGS. 6A–6E show articles not being present within the flights 15 of infeed conveyor 13, these can also be used to schematically represent articles out of a proper or pre-determined position within the tube of packaging film being advanced between the cutting heads 29 of the packaging machine. Again, the only significant change between the no product-no cut method which prevents the formation of empty packages, and the no gap-no seal method is the establishment of a base relationship between the rotational positions of the infeed conveyor drive motor and the film feed drive motor with respect to one another for no gap-no seal, and the mapping of the rotational position of the cutting head drive motor, only, with respect to the base rotational position relationship of the infeed conveyor drive motor and film feed drive motor for the no gap-no seal control method.

What article detectors 56 and 57 do, when being polled by machine controller 34, is determine an input pattern such as those shown in FIGS. 6A–6E. It is in response to these input patterns that the various position control trajectory profiles are calculated, as shown in FIGS. 4A, B, and FIG. 5. Therefore it is possible that a "smart" detector could be used having an integral memory or learning device, for example a programmable detector, such that it will be programmed, for example through a calibration sub-routine, to look for the patterns as shown in FIGS. 6A–6E, and any combinations thereof which may exist, and then signal the appropriate input pattern to the machine controller, thus requiring less of CPU 61, which may be important in the event that the CPU is otherwise busy performing other machine functions, as it is anticipated that machine controller 34 will control not only the processes disclosed herein, but that it will also be adapted to control all other normal horizontal wrapping machine operations, which may include, for example, setting and monitoring the temperatures of the sealing and crimping heads, controlling any article feed devices which may be present, and for performing all other known operations of horizontal wrapping machines, as well as those which can be reasonably anticipated in the future. What would still occur with such an improved detector, however, is that machine controller 34 would still calculate the appropriate position control trajectory profiles, and set the appropriate positional relationships with respect to the mapped and slaved drives for accomplishing the stated objectives of avoiding the formation of empty packages, or forming defective packages, while allowing for increased rates of production at lower reject rates for improving machine efficiency and plant operation.

Figure 7B:
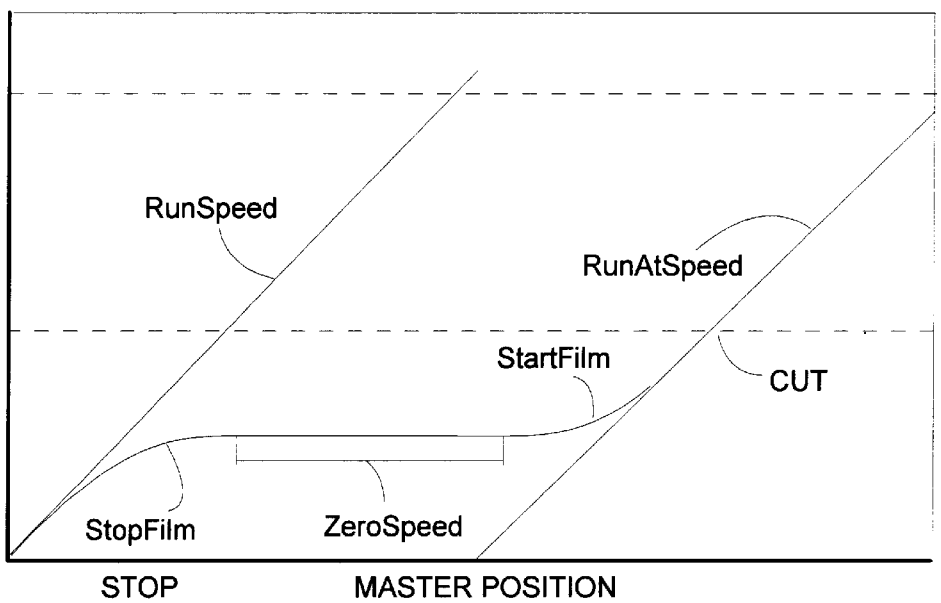
FIG. 7B is a graph illustrating the velocity profile followed by the cutting heads of the packaging machine of FIG. 1 when consecutive empty article receiving flights are detected, or when consecutive out of position articles are present within the tube of packaging film passed between the cutting heads of the packaging machine.
Figure 7A:
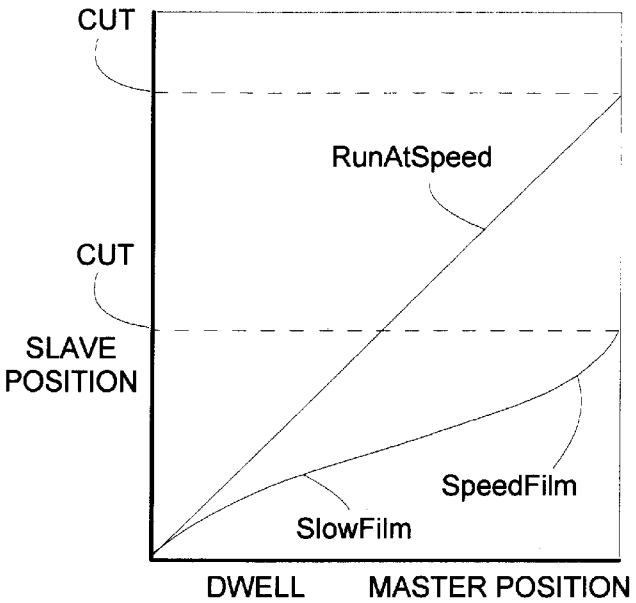
FIG. 7A is a graph illustrating the velocity profile followed by the cutting heads of the packaging machine of FIG. 1 when a single empty article receiving flight is detected, or when a single out of position article is detected within the tube of packaging film to be passed between the cutting heads.

FIG. 7A illustrates a position profile for the film feed drive motor 44 and drive axis 45 thereof, and cutting head assembly drive motor 52 and drive axis 53 thereof, with respect to the linear velocity of the infeed conveyor 13 in the direction of the path of travel, as determined through the rotational position of drive axis 41. The slope of the position profile is representative of the relative velocity of the process. The 45° RunAtSpeed line shown represents a 1:1 relationship in which the rotational position of the slaved drives, the film feed drive motor and the cutting head drive motor in their base relationship, are mapped to the rotational position of infeed conveyor drive motor 40, and all rotate at a 1:1 relationship through their range of motion. The curve shown below the RunAtSpeed line represents the velocity curve which results from the performance of steps 96, and 99–102 of FIG. 4A, in which only a single empty pocket is detected, or a single article is detected out of position with the tube of packaging film for steps 296, and 299–302 of FIG. 4B, whereupon during the SlowFilm trajectory the rotational positions of the film feed and cutting head drive axes are retarded with respect to the rotational position of the infeed conveyor drive axis, having a relatively steady state relationship, yet retarded from the RunAtSpeed line, and then accelerated at the SpeedFilm trajectory portion of the curve so that a package cut takes place. As shown in FIG. 7A, therefore, whereas normally two cuts would take place, i.e. two packaging cycles would occur, only a single packaging cycle occurs in the same period of time, such that the master to slave relationship is 2:1, the infeed conveyor drive advancing through twice the range of rotational positions as do the rotational positions of the film feed and cutting head drives.

FIG. 7B illustrates the position profile for the performance of steps 96, 99, and 103–107 of FIG. 4A, or steps 296, 299, and 303–307 of FIG. 4B, as compared to the 45° RunAtSpeed lines representing the 1:1 mapped relationship of the drives with respect to one another. The slope of the position profile again represents the relative velocity of the drive(s). As can be seen in FIG. 7B, the StopFilm portion of the velocity profile is more pronounced, i.e. has a greater deceleration rate, than the SlowFilm portion of FIG. 7A, and then results in a ZeroSpeed profile in which neither of the film feed drive or cutting head drive axes are rotating, although they are held in a fixed and known rotational position with respect to the ongoing rotational position of drive axis 41 for infeed conveyor drive 40. Thereafter, once an article is detected by article detector 56, or 57, as the case may be, positioned above an upstream flight, and/or upstream of the cutting heads, respectively, the StartFilm trajectory of step 107 for the No Product-No Cut process is then calculated, before the articles enter the film tube, which results in a greater acceleration rate relative to the acceleration rate realized by the calculation of the SpeedFilm trajectory in step 102, as shown in FIG. 7A. The StartFilm trajectory for the No Gap-No Seal process must be calculated at least, preferably, before the in-position article(s) within the film tube arrive at the cutting and sealing heads. Preferably, detector 57 detects the position of the articles within the film tube at a position along the path of travel intermediate the film forming shoe and the cutting and sealing heads, although it is anticipated that detector 56 could also double as detector 57, if so desired.

Thus, rather than having a 2:1 master to slave cycle relationship, it is entirely possible that the master/slave cycle relationships of any number of cycles can be attained in FIG. 7B, steps 96, 99, and 103–107 of FIG. 4A, or steps 296, 299, and 303–307 of FIG. 4B, depending on how long it is before an article is detected within one of the flights 15 of the infeed conveyor, or an article is detected in a proper, i.e. pre-determined, position within the tube of packaging film as it advances toward the cutting heads with article detector 57. Also, it will be appreciated from the foregoing that the concept of slowing, rather than stopping the operational components of a system while otherwise maintaining the positional constraints of the system components during an operational process can be applied to other cyclic operations involving more than the packaging of articles within a packaging film web.

Other possible applications of the methodology, as well as the structure, of the invention include the wrapping of articles having varying cut-off lengths, i.e. the length of the package between the end seal and crimp at the respective ends of the package varies, as well as with packages of varying lengths; and for wrapping a randomly ordered or spaced stream of articles advancing along a non-flighted conveyor belt or line. In this latter instance, it is anticipated that the infeed detector/sensor would register the position of the incoming article within the machine controller, and each wrapping cycle would have a custom generated motion control trajectory, or cam profile, calculated by the machine controller. The packaging film drive and the sealing and crimping head drive would each be slaved to the spacing of the incoming articles while maintaining the creation of uniform wrapped article packages. Just as the above-described No Product No Cut and No-Gap No-Seal embodiments slow for a missing article, this new embodiment would slow for articles that were spaced too far apart, and would accelerate for articles spaced too closely together to maintain the positional relationship of the article placement location with respect to the articles being wrapped/packaged. This would in turn eliminate some of those instances in which the No-Gap No-Seal method would cause the formation of scrap packages passed along the path of travel and between the sealing and cutting heads.

While preferred embodiments of the invention have been disclosed in the foregoing specification, it is understood by those skilled in the art that variations and modifications thereof can be made without departing from the spirit and scope of the invention, as set forth in the following claims. Moreover, the corresponding structures, materials, acts, and equivalents of all means or step plus function elements in the claims are intended to include any structure, material, or act for performing the functions in combination with other claimed elements, as specifically claimed herein.

We claim:

1. A method of controlling the operation of a packaging machine to prevent the formation of an empty package, the packaging machine having a supply of articles to be packaged, a machine controller, an endless infeed conveyor extending along at least a portion of a path of travel extending through the packaging machine, the infeed conveyor having a series of spaced article receiving flights defined along its length for being supplied with the articles to be packaged and being driven in the direction of the path of travel by a first drive, a supply of packaging film, a packaging film forming shoe positioned along the path of travel downstream of the infeed conveyor for forming the film as a tube about the articles, and a pair of opposed and counter-rotating cutting heads positioned along the path of travel downstream of the film forming shoe, the packaging film being driven toward the film forming shoe by a second drive, and the cutting heads being driven by a third drive, said method comprising the steps of:

a) determining an initial rotational position for each of the first, second, and third drives, respectively;

b) establishing a base rotational position relationship of the second drive and the third drive with respect to one another, and maintaining said base relationship during the operation of the packaging machine;

c) mapping said base relationship to the rotational position of the first drive; and d) calculating a first position control trajectory profile within the machine controller and establishing a first rotational position relationship of the second and third drives, respectively, with respect to the rotational position of the first drive.

2. The method of claim 1, comprising the steps of:

a) moving the articles to be packaged along the path of travel within the article receiving flights of the infeed conveyor;

b) detecting, with an article detector positioned upstream of the film forming shoe, whether an article is present within a first flight of the infeed conveyor as the flight moves along the path of travel;

c) calculating a second position control trajectory profile in response to detecting the absence of an article within said first flight;

d) replacing the first position control trajectory profile within the machine controller with the second position control trajectory profile; and e) in response thereto, retarding the rotational position of the second and third drives, respectively, with respect to the rotational position of the first drive.

3. The method of claim 2, further comprising the steps of:

a) detecting whether an article is present within a second flight upstream of said first flight as the infeed conveyor advances along the path of travel;

b) calculating a third position control trajectory profile in response to detecting the presence of an article within said second flight;

c) replacing the second position control trajectory profile within the machine controller with the third position control trajectory profile; and d) in response thereto, advancing the rotational position of the second and third drives, respectively, with respect to the rotational position of the first drive.

4. The method of claim 3, further comprising the steps of:

a) detecting whether an article is present within a third flight upstream of said second flight as the infeed conveyor advances along the path of travel;

b) calculating said first position control trajectory profile in response to detecting the absence of an article within said third flight;

c) replacing the third position control trajectory profile within the machine controller with said first position control trajectory profile; and d) in response thereto, restoring the first rotational position relationship of the second and third drives, respectively, with respect to the rotational position of the first drive.

5. The method of claim 2, further comprising the steps of:

a) detecting whether an article is present within a second flight upstream of said first flight as the infeed conveyor advances along the path of travel;

b) calculating a third position control trajectory profile in response to detecting the presence of an article within said second flight;

c) replacing the second position control trajectory profile within the machine controller with the third position control trajectory profile; and d) in response thereto, dwelling the second and third drives respectively, in a fixed rotational position with respect to the rotational position of the first drive.

6. The method of claim 5, further comprising the steps of:

a) detecting whether an article is present within a third flight upstream of said second flight as the infeed conveyor advances along the path of travel;

b) calculating a fourth position control trajectory profile in response to detecting the absence of an article within said second flight;

c) replacing said third position control trajectory profile within the machine controller with the fourth position control trajectory profile; and d) in response thereto, advancing the rotational position of the second and third drives, respectively, with respect to the rotational position of the first drive.

7. The method of claim 6, further comprising the steps of:

a) detecting whether an article is present within a fourth flight upstream of said third flight as the infeed conveyor advances along the path of travel;

b) calculating said first position control trajectory profile in response to detecting the presence of an article within said fourth flight;

c) replacing said third position control trajectory profile within the machine controller with said first position control trajectory profile; and d) in response thereto, restoring the first rotational position relationship of the second and third drives, respectively, with respect to the rotational position of the first drive.

8. A method of controlling the operation of a packaging machine to prevent the formation of an empty package, the packaging machine having a supply of articles to be packaged, an endless infeed conveyor extending along at least a portion of a path of travel extending through the packaging machine, the infeed conveyor having a series of spaced article receiving flights defined along its length for being supplied with the articles to be packaged and being driven at a predetermined linear rate of speed in the direction of the path of travel by a first drive, a supply of packaging film, a packaging film forming shoe positioned along the path of travel downstream of the infeed conveyor for forming the film as a tube about the articles, and a pair of opposed and counter-rotating cutting heads positioned along the path of travel downstream of the film forming shoe, the packaging film being driven toward the film forming shoe by a second drive, and the cutting heads being driven by a third drive, said method comprising the steps of:

a) determining an initial rotational position of the first drive, the second drive, and the third drive, respectively;

b) establishing a base rotational position relationship of the second drive and the third drive with respect to one another;

c) calculating a first position control trajectory profile; and d) establishing a first rotational position relationship of the second and third drives, respectively, with respect to the rotational position of the first drive.

9. The method of claim 8, further comprising the step mapping the base rotational position relationship of the second and third drives to the rotational position of the first drive.

10. The method of claim 8, wherein step b) comprises the step of maintaining said base rotational position relationship of the second and third drives with respect to one another during operation of the packaging machine.

11. The method of claim 8, further comprising the steps of:

a) moving the articles to be packaged along the path of travel within the article receiving flights of the infeed conveyor;

b) detecting, with an article detector positioned upstream of the film forming shoe, whether an article is present within a first flight of the infeed conveyor as the flight moves along the path of travel;

c) calculating a second position control trajectory profile in response to detecting the absence of an article within said first flight; and d) in response thereto, changing the rotational positional relationship of the second and third drives, respectively, with respect to the rotational position of the first drive from said first rotational position relationship to a second rotational position relationship.

12. The method of claim 11, further comprising the steps of:

a) recording an input pattern of the articles passing by said detector within the flights of the infeed conveyor; and b) using said input pattern to selectively calculate said first and said second position control trajectory profiles in response thereto.

13. The method of claim 11 wherein step d) of changing from said first rotational position relationship to said second rotational position relationship includes the step of retarding the linear speed of the packaging film and the rotation of the cutting heads in the direction of the path of travel to a rate of speed less than the linear speed of the infeed conveyor in the direction of the path of travel.

14. The method of claim 11, wherein step d) of changing from said first rotational position relationship to said second rotational position relationship includes the step of retarding the rotational position of the second and third drives, respectively, with respect to the rotational position of the first drive.

15. The method of claim 11, further comprising the steps of:

a) detecting whether an article is present within a second flight upstream of said first flight as the infeed conveyor moves along the path of travel;

b) moving the packaging film, and rotating the cutting heads in the direction of the path of travel at a rate of speed greater than zero in response to detecting an article in said second flight;

c) passing the article in said second flight into the tube of packaging film at the film forming shoe; and d) changing said second rotational position relationship back to said first rotational position relationship in response to passing the article in the second flight into the tube of packaging film so that the formation of an empty package is avoided.

16. The method of claim 11, further comprising the steps of:

a) detecting whether an article is present within a second flight upstream of said first flight as the infeed conveyor moves along the path of travel;

b) calculating a third position control trajectory profile in response to detecting the presence of an article within said second flight; and c) in response thereto, changing the rotational position relationship of the second and third drives, respectively, with respect to the rotational position relationship of the first drive from said second rotational position relationship to a third rotational position relationship.

17. The method of claim 16, wherein step c) of changing from said second rotational position relationship to said third rotational position relationship includes the step of advancing the linear speed of the packaging film and the rotation of the cutting heads in the direction of the path of travel to a rate of speed greater than the linear speed of the infeed conveyor in the direction of the path of travel.

18. The method of claim 16, wherein step c) of changing from said second rotational position relationship to said third rotational position relationship includes the step of advancing the rotational position of the second and third drives, respectively, with respect to the rotational position of the first drive.

19. The method of claim 16, further comprising the steps of:

a) detecting whether an article is present within a third flight upstream of said second flight as the infeed conveyor advances along the path of travel;

b) calculating said first position control trajectory in response to detecting the presence of an article within said third flight; and c) in response thereto, restoring said first rotational position relationship of the second and third drives, respectively, with respect to the rotational position of the first drive.

20. The method of claim 11, further comprising the steps of:

a) detecting whether an article is present within a second flight upstream of said first flight as the infeed conveyor moves along the path of travel;

b) calculating a third position control trajectory profile in response to detecting the absence of an article within said second flight; and c) in response thereto, changing the rotational position relationship of the second and third drives, respectively, with respect to the rotational position relationship of the first drive from said second rotational position relationship to a third rotational position relationship.

21. The method of claim 20, wherein step c) of changing from said second rotational position relationship to said third rotational position relationship includes the step of dwelling the second and third drives, respectively, in a fixed rotational position with respect to the rotation of the first drive as it continues to move the infeed conveyor in the direction of the path of travel.

22. The method of claim 20, further comprising the steps of:

a) detecting whether an article is present within a third flight upstream of said second flight as the infeed conveyor advances along the path of travel;

b) calculating a fourth position control trajectory profile in response to detecting the presence of the an article within said third flight; and c) in response thereto, changing the rotational position relationship of the second and third drives, respectively, with respect to the rotational position of the first drive from said third to a fourth rotational position relationship in response thereto.

23. The method of claim 22, wherein step c) of changing from said third rotational position relationship to said fourth rotational position relationship includes the step of advancing the linear speed of the film feed and the rotation of the cutting heads in the direction of the path of travel to a rate of speed greater than said the linear speed of the infeed conveyor in the direction of the path of travel.

24. The method of claim 22, wherein step c) of changing from said third rotational position relationship to said fourth rotational position relationship includes the step of advancing the rotational position of the second and third drives, respectively, with respect to the rotational position of the first drive.

25. The method of claim 22, comprising the steps of:

a) detecting whether an article is present within a fourth flight upstream of said third flight as the infeed conveyor advances along the path of travel;

b) calculating said first position control trajectory in response to detecting the presence of an article within said fourth flight; and c) in response thereto, restoring the first rotational position relationship of the second and third drives, respectively, with respect to the rotational position of the first drive.

26. A method of controlling the operation of a packaging machine, the packaging machine having a supply of articles to be packaged, an endless infeed conveyor extending along at least a portion of a path of travel extending through the packaging machine, the infeed conveyor having a series of spaced article receiving flights defined along its length for being supplied with the articles to be, a supply of packaging film, a packaging film forming shoe positioned along the path of travel downstream of the infeed conveyor for forming the film as a tube about the articles, and a pair of opposed and counter-rotating cutting heads positioned along the path of travel downstream of the film forming shoe, said method comprising the steps of:

a) moving the articles to be packaged along the path of travel within the article receiving flights of the infeed conveyor packaged in the direction of the path of travel with a first drive;

b) moving the packaging film in the direction of the path of travel toward the film forming shoe with a second drive;

c) rotating the cutting heads of the cutting head assembly in the direction of the path of travel with a third drive;

d) mapping a first rotational position relationship of the second drive and the third drive with respect to the first drive;

d) detecting, with an article detector positioned upstream of the film forming shoe, whether an article is present within a first flight of the infeed conveyor as the flight moves along the path of travel; and e) in response to detecting the absence of an article within said first flight, retarding the rotational position of the second drive and of the third drive, respectively, with respect to the rotational position of the first drive while maintaining a fixed rotational position relationship between the second drive and the third drive.

27. The method of claim 26, comprising the steps of:

a) detecting whether an article is present within a second flight upstream of said first flight as the infeed conveyor moves along the path of travel; and b) in response thereto, advancing the rotational position of the second drive and of the third drive, respectively, with respect to the rotational position of the first drive, while maintaining said fixed rotational position relationship between the second drive and the third drive.

28. The method of claim 27, further comprising the steps of:

a) detecting whether an article is present within a third flight upstream of said second flight as the infeed conveyor moves along the path of travel; and b) in response thereto, restoring the rotational position of the first drive, the second drive, and of the third drive with respect to one another in said first rotational position relationship.

29. A method of controlling the operation of a packaging machine to prevent the cutting of an article being packaged by the machine, the packaging machine having a supply of articles to be packaged, an endless infeed conveyor extending along and moving in the direction of a path of travel through the packaging machine, the infeed conveyor having a series of spaced article receiving flights defined along its length for being supplied with the articles to be packaged, a supply of packaging film, a packaging film forming shoe positioned along the path of travel downstream of the infeed conveyor for forming the packaging film as a tube about the spaced articles, a fin seal assembly positioned along the path of travel downstream of the film forming shoe for forming a fin seal in the tube of packaging film, and a cutting head assembly having a pair of counter-rotating sealing and cutting heads positioned along the path of travel downstream of the fin seal assembly, said method comprising the steps of:

a) moving the articles to be packaged along the path of travel within the article receiving flights of the infeed conveyor with a first drive;

b) moving the packaging film in the direction of the path of travel toward the film forming shoe with a second drive;

c) rotating the cutting heads of the cutting head assembly in the direction of the path of travel with a third drive;

d) establishing a base rotational position relationship of the first drive and the second drive with respect to one another, and calculating a first rotational position relationship between the rotational positions of the first and the second drives, respectively, in said base relationship with respect to the rotational position of the third drive;

e) detecting, with an article detector positioned with respect to the fin seal assembly, whether a first article is present within the tube of packaging film moving toward the cutting head assembly; and f) in response to detecting the presence of the first article within the tube of packaging film, calculating a second rotational position relationship between the rotational position of the third drive with respect to the rotational positions of the first and second drives, respectively, while maintaining said base relationship between the first drive and the second drive with respect to one another.

30. The method of claim 29, wherein step f) further comprises the steps of:

a) retarding the rotational position of the third drive in the direction of the path of travel with respect to the rotational positions of the first drive and the second drive in the direction of the path of travel; and b) passing the tube of packaging film with the first article entrained therein between the cutting heads without cutting the packaging film.

31. The method of claim 29, further comprising the steps of:

a) detecting whether a second article is present within the tube of packaging film upstream of the first article as the infeed conveyor and packaging film continue to move along the path of travel;

b) in response to detecting the absence of the second article within the tube of packaging film, calculating a third rotational position relationship between the rotational position of the third drive with respect to the rotational positions of the first and second drives, respectively, and advancing the rotational position of the third drive with respect to the rotational positions of the first drive and the second drive while maintaining said base relationship between the first drive and the second drive; and c) cutting the packaging film with the cutting heads once the second article has passed therebetween.

32. The method of claim 31, further comprising the steps of:

a) detecting whether a third article is present is present within the tube of packaging film upstream of the first article as the infeed conveyor and packaging film continue to move along the path of travel; and b) in response to detecting the absence of the third article within the tube of packaging film, restoring said first rotational position relationship between the third drive with respect to the first drive and the second drive while maintaining said fixed rotational position relationship between the first drive and the second drive.

33. The method of claim 29, further comprising the steps of:

a) detecting whether a second article is present within the tube of packaging film upstream of the first article as the infeed conveyor and packaging film continue to move along the path of travel;

b) in response to detecting the presence of the second article within the tube of packaging film, calculating a third rotational position relationship between the rotational position of the third drive with respect to the rotational positions of the first and second drives, respectively, and holding the third drive in a fixed rotational position with respect to the rotational positions of the first drive and the second drive while maintaining said base relationship between the first drive and the second drive; and c) continuing to pass the packaging film between the cutting heads without cutting the packaging film.

34. The method of claim 29, further comprising the step of mapping the rotational position of the third drive to the rotational positions of the first drive and the second drive, respectively, when in said fixed rotational position relationship.

35. A packaging machine for packaging articles, the packaging machine having a path of travel extending through the packaging machine, a supply of articles to be packaged, and a supply of packaging film, said packaging machine comprising:

an endless infeed conveyor extending along at least a portion of a path of travel, said infeed conveyor having a series of spaced article receiving flights defined along its length for being supplied with the articles to be packaged and being driven in the direction of the path of travel by a first drive;

a packaging film forming shoe positioned along the path of travel downstream of the infeed conveyor for forming the film as a tube about the articles, the packaging film being driven toward the film forming shoe by a second drive;

a pair of opposed and counter-rotating cutting heads positioned along the path of travel downstream of the film forming shoe, the cutting heads being driven by a third drive; and a machine controller in operative communication with said first, said second, and said third drives, said controller being constructed and arranged to:

a) determine an initial rotational position of the first drive, the second drive, and the third drive, respectively;

b) establish a base rotational position relationship of the second drive and the third drive with respect to one another;

c) calculate at least a first position control trajectory profile for controlling the rotational position of said second and third drives in said base rotational position with respect to the rotational position of said first drive; and d) establish at least a first rotational position relationship of the second and third drives, respectively, with respect to the rotational position of the first drive.

36. The packaging machine of claim 35, said machine controller being constructed and arranged to map the base rotational position relationship of the second and third drives, respectively, to the rotational position of the first drive throughout operation of the packaging machine.

37. The packaging machine of claim 35, said machine controller being constructed and arranged to maintain said base rotational position relationship of the second and third drives with respect to one another throughout packaging machine operation.

38. The packaging machine of claim 35, further comprising detecting means positioned with respect to the film forming shoe and along the path of travel for detecting whether an article is present within the respective flights of the infeed conveyor as the flights move along the path of travel toward said film forming shoe.

39. The packaging machine of claim 38, wherein said machine controller is constructed and arranged to calculate at least a second position control trajectory profile in response to detecting the absence of an article within at least one of said flights, and to change from said at least a first rotational position relationship to a second rotational position relationship of the second and third drives, respectively, with respect to the rotational position of the first drive in response thereto.

40. The packaging machine of claim 38, said detecting means comprising a detector positioned upstream of the film forming shoe in operative communication with said machine controller, and a programmable limit switch provided as a part of a control program stored within said machine controller, said programmable limit switch being constructed and arranged to selectively poll said detector in response to a command signal emitted from said machine controller.

41. The packaging machine of claim 38, wherein said detecting means includes a detector positioned upstream of the film forming shoe, said detector being in operative communication with said machine controller, said detecting means being constructed and arranged to record an input pattern of articles passing by said detector within the flights of the infeed conveyor, said machine controller being constructed and arranged to selectively calculate said at least a first position control trajectory profile in response to said input pattern.

42. The packaging machine of claim 41, wherein said machine controller is constructed and arranged to calculate an active position control trajectory profile for operating the packaging machine, to continuously calculate an inactive position control trajectory profile as said active profile operates the packaging machine, and to continuously replace the active profile with the inactive profile during packaging machine operation in response to changes in said input pattern.

43. The packaging machine of claim 35, wherein said machine controller is constructed and arranged to calculate an active position control trajectory profile for operating the packaging machine, to continuously calculate an inactive position control trajectory profile as said active profile operates the packaging machine, and to continuously replace the active profile with the inactive profile during packaging machine operation.

44. The packaging machine of claim 35, said first, second, and third drives, respectively, each comprising a servomotor and a feedback device for emitting a feedback signal of the position of the respective drive with which each said feedback device is used to said machine controller.

45. The packaging machine of claim 44, wherein said feedback device comprises a feedback device selected from the group consisting of an encoder and a resolver.

46. The packaging machine of claim 35, said machine controller including a computer, said computer being in communication with a memory, and a control program stored within and read out of said memory by said computer, said control program being constructed and arranged to calculate said at least a first position control trajectory profile and to establish said at least a first rotational position relationship of the second and third drives, respectively, with respect to the rotational position of the first drive.

47. In a packaging machine for packaging articles, the packaging machine having a path of travel extending through the packaging machine, a supply of articles to be packaged, a supply of packaging film, an endless infeed conveyor extending along at least a portion of a path of travel and having a series of spaced article receiving flights defined along its length for being supplied with the articles to be packaged and being driven in the direction of the path of travel by a first drive, a packaging film forming shoe positioned along the path of travel downstream of the infeed conveyor for forming the film as a tube about the articles, the packaging film being driven toward the film forming shoe by a second drive, and a pair of opposed and counter-rotating cutting heads positioned along the path of travel downstream of the film forming shoe, the cutting heads being driven in the direction of the path of travel by a third drive, the improvement comprising:

a machine controller in operative communication with the first, the second, and the third drives, respectively, said controller being constructed and arranged to:

a) determine an initial rotational position of the first drive, the second drive, and the third drive, respectively;

b) establish a base rotational position relationship of the second drive and the third drive with respect to one another;

c) calculate a first active position control trajectory profile for controlling the rotational position of the second drive and the third with respect to the rotational position of the first drive;

d) continuously calculate an inactive position control trajectory profile as said active profile operates the packaging machine; and e) to selectively replace the active profile with the inactive profile during packaging machine operation.

48. The packaging machine of claim 47, further comprising a detection means for detecting whether an article is present within the respective flights of the infeed conveyor as the flights move along the path of travel toward said film forming shoe, said detection means including a detector positioned upstream of the film forming shoe in operative communication with said machine controller, said machine controller including a control program with a programmable limit switch provided as a part thereof, wherein said programmable limit switch selectively polls said detector in response to a command signal emitted from said machine controller.

49. The packaging machine of claim 48, wherein said machine controller is constructed and arranged to calculate at least a second position control trajectory profile in response to detecting the absence of an article within at least one of said flights, and to change from said at least a first rotational position relationship to a second rotational position relationship of the second and third drives, respectively, with respect to the rotational position of the first drive in response thereto.

50. The packaging machine of claim 49, wherein said detection means selectively records an input pattern of articles passing by said detector within the flights of the infeed conveyor, said machine controller being constructed and arranged to calculate said at least a first position control trajectory profile and said second position control trajectory profile in response to said input pattern for preventing the formation of an empty package.

51. A method of controlling the operation of an article packaging machine to prevent the formation of empty packages, the packaging machine having a supply of articles to be packaged, an endless infeed conveyor extending along at least a portion of a path of travel extending through the packaging machine, the infeed conveyor having a series of spaced article receiving flights defined along its length for being supplied with the articles to be packaged and being driven in the direction of the path of travel by an infeed conveyor drive axis, a supply of packaging film, a packaging film forming shoe positioned along the path of travel downstream of the infeed conveyor for forming the film as a tube about the articles, and a pair of opposed and counter-rotating cutting heads positioned along the path of travel downstream of the film forming shoe, the packaging film being driven toward the film forming shoe by a film feed drive axis, and the cutting heads being driven by a cutting head drive axis, said method comprising the steps of:

a) determining an initial rotational position of the infeed conveyor drive axis, the film feed drive axis, and the cutting head drive axis, respectively;

b) establishing a base rotational position relationship between the rotational position of the film feed drive axis with respect to the rotational position of the cutting head drive axis during the sealing and cutting of the tube of packaging film formed about the articles being packaged, and mapping said base relationship to the rotational position of the infeed conveyor drive axis;

c) examining the flights of the infeed conveyor with a detection means positioned upstream of the film forming shoe and along the infeed conveyor for signaling whether the respective article receiving flights of the infeed conveyor contain an article to be packaged therein;

d) calculating a first position control trajectory profile for controlling the rotational position of the film feed drive axis and the cutting head drive axis with respect to the rotational position of the infeed conveyor drive axis;

e) transferring the articles from the flights of the infeed conveyor into the tube of packaging film as it is being formed about the articles at the film forming shoe;

f) calculating a second position control trajectory profile in response to the detection of an empty article receiving flight, and in response thereto rotating the film feed drive axis and cutting head drive axis at a speed greater than zero and through a distance equal to a single packaging cycle, and simultaneously rotating the infeed drive axis through a distance equal to two of said cycles;

g) replacing the first position control trajectory profile with the second position control trajectory profile; and h) replacing the second position control trajectory profile with the first position control trajectory profile upon completion of the second position control trajectory profile.

52. A method of controlling the operation of an article packaging machine to prevent the formation of multiple consecutive empty packages, the packaging machine having a supply of articles to be packaged, an endless infeed conveyor extending along at least a portion of a path of travel extending through the packaging machine, the infeed conveyor having a series of spaced article receiving flights defined along its length for being supplied with the articles to be packaged and being driven in the direction of the path of travel by an infeed conveyor drive axis, a supply of packaging film, a packaging film forming shoe positioned along the path of travel downstream of the infeed conveyor for forming the film as a tube about the articles, and a pair of opposed and counter-rotating cutting heads positioned along the path of travel downstream of the film forming shoe, the packaging film being driven toward the film forming shoe by a film feed drive axis, and the cutting heads being driven by a cutting head drive axis, said method comprising the steps of:

a) determining an initial rotational position of the infeed conveyor drive axis, the film feed drive axis, and the cutting head drive axis, respectively;

b) establishing a base rotational position relationship between the rotational position of the film feed drive axis with respect to the rotational position of the cutting head drive axis during the sealing and cutting of the tube of packaging film formed about the articles being packaged, and mapping said base relationship to the rotational position of the infeed conveyor drive axis;

c) examining the flights of the infeed conveyor with a detection means positioned upstream of the film forming shoe and along the infeed conveyor, said detection means signaling whether the respective article receiving flights of the infeed conveyor contain an article to be packaged therein;

d) calculating a first position control trajectory profile for controlling the rotational position of the film feed drive axis and the cutting head drive axis with respect to the rotational position of the infeed conveyor drive axis;

e) transferring the articles from the flights of the infeed conveyor into the tube of packaging film as it is being formed about the articles at the film forming shoe;

f) calculating a second position control trajectory profile in response to the detection of at least two consecutive empty article receiving flights, and in response thereto continuing to rotate the infeed conveyor drive axis while dwelling the rotation of the film feed drive and cutting head drive axes, respectively, in a fixed position with respect to the rotational position of the infeed conveyor drive axis;

g) replacing the first position control trajectory profile with the second position control trajectory profile; and h) replacing the second position control trajectory profile with the first position control trajectory in response to detecting an article within an upstream article receiving flight.

53. A method of controlling the operation of an article packaging machine, the packaging machine having a supply of articles to be packaged, an endless infeed conveyor extending along at least a portion of a path of travel extending through the packaging machine, the infeed conveyor having a series of spaced article receiving flights defined along its length for being supplied with the articles to be packaged and being driven in the direction of the path of travel by an infeed conveyor drive axis, a supply of packaging film, a packaging film forming shoe positioned along the path of travel downstream of the infeed conveyor for forming the film as a tube about the articles, and a pair of opposed and counter-rotating cutting heads positioned along the path of travel downstream of the film forming shoe, the packaging film being driven toward the film forming shoe by a film feed drive axis, and the cutting heads being driven by a cutting head drive axis, to prevent the collision of the cutting heads with an article out of a predetermined packaging position within the tube of packaging film, said method comprising the steps of:

a) determining an initial rotational position of the infeed conveyor drive axis, the film feed drive axis, and the cutting head drive axis, respectively;

b) establishing a base rotational position relationship between the rotational position of the infeed conveyor drive axis and the film feed drive axis, and mapping the rotational position of the cutting head drive axis to said base relationship;

c) transferring the articles present within the flights of the infeed conveyor into the tube of packaging film as it is being formed about the articles at the film forming shoe;

d) examining the tube of packaging filmed and the articles entrained therein with a detection means, positioned intermediate the film forming shoe and the cutting heads, for signaling whether an article is out of a predetermined position within the tube of packaging film;

e) calculating a first position control trajectory profile for controlling the rotational position of the cutting head drive axis with respect to the rotational position of the infeed conveyor drive axis and the film feed drive axis;

f) calculating a second position control trajectory profile in response to the detection of an out of position article, and in response thereto rotating the cutting head drive axis at a speed greater than zero and a through a distance equal to a single packaging cycle and simultaneously rotating the infeed conveyor drive axis and the film feed drive axis through a distance equal to two of said cycles;

g) replacing the first position control trajectory profile with the second position control trajectory profile; and h) replacing the second position control trajectory profile with the first position control trajectory profile upon completion of the second position control trajectory profile.

* * * * *